US009616258B2

(12) United States Patent
Tsuei

(10) Patent No.: US 9,616,258 B2
(45) Date of Patent: Apr. 11, 2017

(54) DISPENSABLE FACE MASK AND METHOD OF MAKING THE SAME

(75) Inventor: Alexander C. Tsuei, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 839 days.

(21) Appl. No.: 13/581,931

(22) PCT Filed: Mar. 1, 2011

(86) PCT No.: PCT/US2011/026580

§ 371 (c)(1),
(2), (4) Date: Aug. 30, 2012

(87) PCT Pub. No.: WO2011/109327

PCT Pub. Date: Sep. 9, 2011

(65) Prior Publication Data

US 2012/0318273 A1 Dec. 20, 2012

Related U.S. Application Data

(60) Provisional application No. 61/309,933, filed on Mar. 3, 2010, provisional application No. 61/309,972, filed
(Continued)

(51) Int. Cl.

| | |
|---|---|
| ***A62B 23/02*** | (2006.01) |
| ***A41D 13/11*** | (2006.01) |
| ***B65H 45/24*** | (2006.01) |

(52) U.S. Cl.

CPC ..... *A62B 23/025* (2013.01); *A41D 13/1115* (2013.01); *B65H 45/24* (2013.01); *Y10T 156/1015* (2015.01); *Y10T 156/1023* (2015.01)

(58) Field of Classification Search

CPC ..... A62B 23/02; A62B 23/025; A41D 13/11; A41D 13/113; A41D 13/1115; A61M 16/06

See application file for complete search history.

(56) References Cited

U.S. PATENT DOCUMENTS 2,619,226 A 11/1952 Adams
3,288,138 A 11/1966 Sachs
(Continued)

FOREIGN PATENT DOCUMENTS

CN 1319440 10/2001
CN 2860138 U 1/2007
(Continued)

OTHER PUBLICATIONS

International Search Report, International Application No. PCT/US2011/026580, date of mailing, Nov. 21, 2011, 4 pages.
(Continued)

*Primary Examiner* — Valerie L Woodward
*Assistant Examiner* — Douglas Sul

(57) ABSTRACT

A method of making a face mask is disclosed. The method includes providing an elastic nonwoven web continuous in a machine direction, the elastic nonwoven web having a central lane extending in the machine direction; bonding a filtering web to the central lane of the elastic nonwoven web to provide a layered web, the filtering web being continuous in the machine direction and having a cross-web width that is substantially the same as the cross-web width of the central lane; and stamping a face mask into the layered web. A face mask and a continuous layered web having a plurality of face masks disposed thereon are also disclosed.

18 Claims, 9 Drawing Sheets

Related U.S. Application Data on Mar. 3, 2010, provisional application No. 61/384,027, filed on Sep. 17, 2010, provisional application No. 61/384,044, filed on Sep. 17, 2010, provisional application No. 61/409,363, filed on Nov. 2, 2010.

(56) References Cited

U.S. PATENT DOCUMENTS

| | | | | |
|---|---|---|---|---|
| 3,306,492 | A | 2/1967 | Kugler | |
| 3,316,904 | A | 5/1967 | Wall | |
| 3,664,335 | A | 5/1972 | Boucher | |
| 3,886,597 | A | 6/1975 | Dupre | |
| 4,038,979 | A | 8/1977 | McCosker | |
| 4,084,585 | A | 4/1978 | Venaleck | |
| 4,118,531 | A | 10/1978 | Hauser | |
| 4,131,195 | A | 12/1978 | Worrell, Sr. | |
| 4,215,682 | A | 8/1980 | Kubik | |
| 4,375,718 | A | 3/1983 | Wadsworth | |
| 4,592,815 | A | 6/1986 | Nakao | |
| 4,688,566 | A | 8/1987 | Boyce | |
| 4,790,307 | A | 12/1988 | Haber et al. | |
| 4,802,473 | A | 2/1989 | Hubbard | |
| 4,827,923 | A | 5/1989 | Bishop | |
| 4,856,509 | A | 8/1989 | Lemelson | |
| 4,874,659 | A | 10/1989 | Ando | |
| 4,969,457 | A | 11/1990 | Hubbard | |
| 5,025,052 | A | 6/1991 | Crater | |
| 5,099,026 | A | 3/1992 | Crater | |
| 5,322,061 | A | 6/1994 | Brunson | |
| 5,401,446 | A | 3/1995 | Tsai | |
| 5,645,057 | A | 7/1997 | Watt | |
| 5,694,925 | A | 12/1997 | Reese et al. | |
| 5,706,804 | A | 1/1998 | Baumann | |
| 5,717,991 | A | 2/1998 | Nozaki | |
| 5,727,544 | A | 3/1998 | Miura | |
| 5,868,276 | A | 2/1999 | Loppnow | |
| 6,010,766 | A | 1/2000 | Braun | |
| 6,070,579 | A | 6/2000 | Bryant | |
| 6,127,485 | A | 10/2000 | Klun | |
| 6,394,090 | B1 | 5/2002 | Chen | |
| 6,615,838 | B1 | 9/2003 | Tsai | |
| 6,644,314 | B1 | 11/2003 | Elsberg | |
| 6,715,633 | B2 | 4/2004 | Thoms | |
| 6,868,984 | B2 | 3/2005 | Griesbach, III | |
| 7,017,577 | B2 * | 3/2006 | Matich | 128/206.14 |
| 7,290,545 | B2 * | 11/2007 | Kleman et al. | 128/206.19 |
| 7,571,832 | B2 | 8/2009 | Mark | |
| 7,845,351 | B2 | 12/2010 | Mathis | |
| 2002/0060222 | A1 | 5/2002 | Bando | |
| 2002/0104543 | A1 * | 8/2002 | Hollander et al. | 128/205.29 |
| 2004/0056043 | A1 | 3/2004 | Griesbach | |
| 2004/0074498 | A1 | 4/2004 | Begum | |
| 2004/0078860 | A1 * | 4/2004 | Bell et al. | 2/9 |
| 2004/0078869 | A1 * | 4/2004 | Bell et al. | A42B 1/18 2/206 |
| 2004/0099677 | A1 | 5/2004 | Harris et al. | |
| 2004/0121107 | A1 | 6/2004 | Bell et al. | |
| 2005/0000976 | A1 | 1/2005 | Keberlein | |
| 2005/0051567 | A1 | 3/2005 | Bell | |
| 2007/0012714 | A1 | 1/2007 | Bagwell et al. | |
| 2007/0062843 | A1 | 3/2007 | Rudd | |
| 2007/0157932 | A1 | 7/2007 | Cerbini | |
| 2007/0262086 | A1 | 11/2007 | Cook | |
| 2008/0035153 | A1 * | 2/2008 | Lin | 128/206.27 |
| 2008/0302814 | A9 | 12/2008 | Fenton | |
| 2009/0260635 | A1 | 10/2009 | Dean | |
| 2010/0154804 | A1 | 6/2010 | Duffy | |
| 2010/0307503 | A1 | 12/2010 | Iwamoto et al. | |
| 2012/0325843 | A1 | 12/2012 | Tsuei | |
| 2014/0224261 | A1 * | 8/2014 | Tsuei | 128/863 |

FOREIGN PATENT DOCUMENTS

| | | |
|---|---|---|
| CN | 101317703 | 12/2008 |
| CN | 101396178 | 4/2009 |
| CN | 201376702 | 1/2010 |
| EP | 0341874 | 11/1989 |
| EP | 0391725 | 10/1990 |
| JP | 57-23357 | 2/1982 |
| JP | 60-6547 | 1/1985 |
| JP | 11-114080 | 4/1999 |
| JP | 2001-198231 | 7/2001 |
| JP | 2007-021031 | 2/2007 |
| JP | 2007-54381 | 3/2007 |
| JP | 2007-159788 | 6/2007 |
| JP | 2008-000191 | 1/2008 |
| JP | 2011-160944 | 8/2011 |
| WO | WO 9638620 | 12/1996 |
| WO | WO 97/40890 | 11/1997 |
| WO | WO 2004-048226 | 6/2004 |
| WO | WO 2004-060090 | 7/2004 |
| WO | WO 2007-010967 | 1/2007 |
| WO | WO 2008/009651 | 1/2008 |
| WO | WO 2013-036769 | 3/2013 |

OTHER PUBLICATIONS

Scan of front and back of face mask package, available outside of the United States before Mar. 3, 2010, 2 pages.

Supplementary European Search Report for Application No. 11751159, dated Aug. 1, 2016, 4 pages.

Supplementary European Search Report on European Patent Application No. EP 11 72 1249, dated Jul. 1, 2016, 3 pages.

* cited by examiner

DISPENSABLE FACE MASK AND METHOD OF MAKING THE SAME

CROSS-REFERENCE TO RELATED APPLICATIONS

This application is a national stage filing under 35 U.S.C. 371 of PCT/US2011/026580, filed Mar. 1, 2011, which claims priority to U.S. Provisional Application Nos. 61/309,933 and 61/309,972, both filed Mar. 3, 2010; 61/384,027 and 61/384,044, both filed Sep. 17, 2010; and 61/409,363, filed Nov. 2, 2010, the disclosures of which are incorporated by reference herein in their entirety.

BACKGROUND

Protective face masks are useful in a number of fields. In the health care field, a face mask may be useful for protecting both the patient and the health care provider from airborne pathogens or for preventing the transfer of pathogens that reside in bodily fluids or other liquids. Wearing protective face masks may also be useful in many industrial settings.

Many protective face masks are constructed to have a front panel that covers the nose and mouth of a user and a securing device (e.g., manual tie straps) that can attach this front panel securely to the head of the user. Often, the front panel and the tie straps are created separately in separate processes and then attached to one another (e.g., using adhesives, staples, or other mechanical fasteners). Face masks constructed from separate parts that must be joined together suffer from disadvantages. The attachment point between the front panel and the tie strap of a face mask may be broken, for example, by pulling on the tie strap. Also, the separate manufacturing processes of the separate parts and the joining step may result in a process that is relatively costly and time consuming. Additionally, the attachment points may be sites of weakness in the face mask. For example, the attachment of the two parts may result in apertures in the face mask that allow for the transfer of pathogens to or from the wearer of the face mask.

So-called single piece face masks are known. In this type of face mask, the front panel is formed integrally with side panels with openings that are used to attach the face mask to the wearer. The front panel and the side panels may be die cut from a web of material and formed at the same time. Some of these masks are stretchable to achieve a better fit on the face of the wearer. However, a stretchable, single piece face mask may not have the filtering efficiency desired for some applications.

Reliable face masks and convenient manufacturing processes for making them continue to be desired.

SUMMARY

The present disclosure provides a face mask in which the portion for wearing over at least a portion of a nose and mouth of a wearer and the portions for securing the face mask to the head of the wearer are formed as a unitary structure. The face mask comprises an elastic sheet of an elongated shape, at least a portion of which can be stretched during wear to fit around the face of the wearer, and a filtering web portion in the central portion of the elastic sheet. Advantageously, the face masks can be manufactured using continuous web processing of an elastic nonwoven web and a filtering web.

In one aspect, the present disclosure provides a method of making a face mask, the method comprising:

providing an elastic nonwoven web continuous in a machine direction, the elastic nonwoven web having a central lane extending in the machine direction, the central lane having a cross-web width;

bonding a filtering web to the central lane of the elastic nonwoven web to provide a layered web, the filtering web being continuous in the machine direction and having a cross-web width that is substantially the same as the cross-web width of the central lane; and stamping a face mask into the layered web, the face mask comprising a portion of the elastic nonwoven web and a portion of the filtering web, the portion of the elastic nonwoven web having an elongated shape with a central portion stamped from the central lane of the elastic nonwoven web and first and second lateral end portions each flanking the central portion on opposite sides, wherein the portion of the filtering web is bonded to the central portion. In some embodiments, the face mask further comprises a first opening in first lateral end portion and a second opening in the second lateral end portion. In other embodiments, face mask further comprises a first punch-out member in the first lateral end portion and a second punch-out member in the second lateral end portion. The punch-out members can be removed to form first and second openings for ear engagement in the first and second lateral end portions.

In another aspect the present disclosure provides a face mask comprising:

an elastic nonwoven sheet having an elongated shape, a central portion, first and second lateral end portions each flanking the central portion on opposite sides, a first opening in the first lateral end portion, and a second opening in the second lateral end portion; and a filtering web portion bonded to the central portion of the elastic nonwoven sheet, wherein the filtering web portion is bonded to the central portion in a manner such that the central portion has a reduced elongation relative to the first and second lateral end portions.

In other aspect, the present disclosure provides a flat, stretchable face mask comprising a layer of elastic material and at least one partial layer of a flat-pleated material having at least one flat pleat, wherein upon stretching the flat, stretchable face mask, the elastic material stretches and the at least one flat pleat at least partially opens to expand the at least one partial layer. In some embodiments, the elastic material is an elastic nonwoven sheet as described above, and at least one of the partial layers of flat-pleated material is a filtering web portion bonded to the central portion of the elastic nonwoven sheet.

In another aspect the present disclosure provides a continuous layered web comprising a plurality of face masks consecutively positioned in a machine direction, the continuous layered web having a first longitudinal edge and a second longitudinal edge, each of the face masks comprising a portion of a elastic nonwoven web and a portion of a filtering web, the portion of the elastic nonwoven web having an elongated shape, a central portion, and first and second lateral end portions each flanking the central portion on opposite sides, the first lateral end portion extending to the first longitudinal edge of the continuous layered web and the second lateral end portion extending to the second longitudinal edge of the continuous web, wherein the portion of the filtering web is bonded to the central portion. In some embodiments, the face mask further comprises a first opening in first lateral end portion and a second opening in the second lateral end portion. In other embodiments, face mask further comprises a first punch-out member in the first lateral end portion and a second punch-out member in the second lateral end portion. The punch-out members can be removed to form first and second openings for ear engagement in the first and second lateral end portions.

In any of the aforementioned aspects, the central portion of the elastic nonwoven sheet or the central portion of the portion of the elastic nonwoven web is for wearing over a mouth and at least a portion of a nose of a person. The first and second lateral end portions are for at least partially extending around opposite sides of a person's face to engage the ears of the person. The first opening and the second opening each can engage an ear of the person.

The face mask according to and/or made according to the present disclosure has a filtering portion that can be selected so that the face mask provides the desired amount of protection for the desired application. The filtering web portion may be provided on the face mask using continuous web processing. Furthermore, the face mask has a configuration that allows it to be readily dispensable from a variety of different dispensers.

Accordingly, in another aspect, the present disclosure provides a dispenser comprising a container enclosing a plurality of face masks comprising a face mask according to any of the aforementioned aspects, the container having at least one side with an aperture for removing the plurality of face masks.

In this application, terms such as "a", "an" and "the" are not intended to refer to only a singular entity, but include the general class of which a specific example may be used for illustration. The terms "a", "an", and "the" are used interchangeably with the term "at least one". The phrases "at least one of" and "comprises at least one of" followed by a list refers to any one of the items in the list and any combination of two or more items in the list. All numerical ranges are inclusive of their endpoints and non-integral values between the endpoints unless otherwise stated.

The terms "first" and "second" are used in this disclosure. It will be understood that, unless otherwise noted, those terms are used in their relative sense only. In particular, in some embodiments certain components may be present in interchangeable and/or identical multiples (e.g., pairs). For these components, the designation of "first" and "second" may be applied to the components merely as a matter of convenience in the description of one or more of the embodiments.

The term "nonwoven" when referring to a sheet or web means having a structure of individual fibers or threads which are interlaid, but not in an identifiable manner as in a knitted fabric. Nonwoven fabrics or webs can be formed from various processes such as meltblowing processes, spunbonding processes, spunlacing processes, and bonded carded web processes.

The term "elastic" refers to any material, including a film, fiber, nonwoven web, or combination thereof, which exhibits recovery from stretching or deformation.

The above summary of the present disclosure is not intended to describe each disclosed embodiment or every implementation of the present disclosure. The description that follows more particularly exemplifies illustrative embodiments. It is to be understood, therefore, that the drawings and following description are for illustration purposes only and should not be read in a manner that would unduly limit the scope of this disclosure.

BRIEF DESCRIPTION OF THE DRAWINGS

The disclosure may be more completely understood in consideration of the following detailed description of various embodiments of the disclosure in connection with the accompanying drawings, in which.

DETAILED DESCRIPTION

Figure 1:
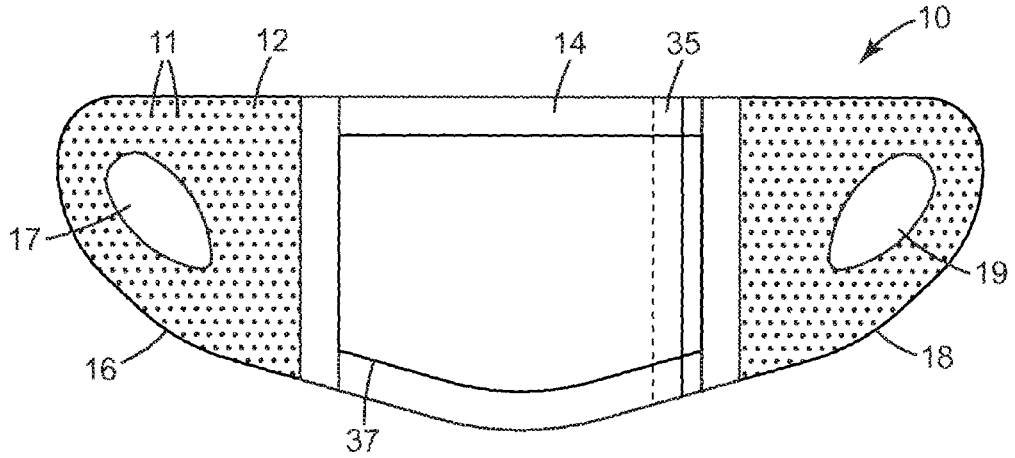
FIG. 1 is a plan view of an exemplary face mask according to and/or made according to the present disclosure, which plan view is of the wearer-facing side.

Reference will now be made in detail to embodiments of the disclosure, one or more examples of which are illustrated in the drawings. Features illustrated or described as part of one embodiment can be used with other embodiments to yield still a third embodiment. It is intended that the present disclosure include these and other modifications and variations.

Figure 2:
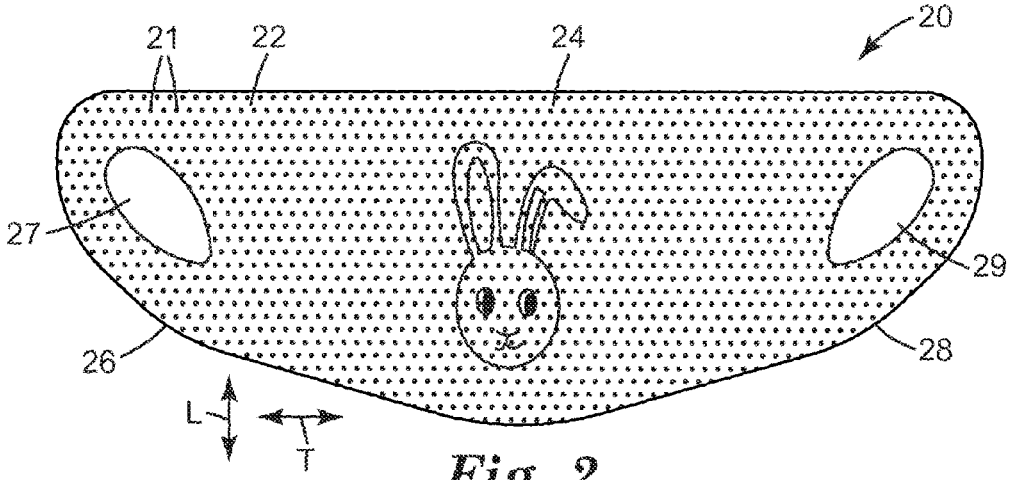
FIG. 2 is a plan view of an exemplary embodiment of a face mask according to and/or made according to the present disclosure, which plan view is of the outward-facing side.

Face masks 10 and 20 according to and/or made according to the present disclosure are shown in FIGS. 1 and 2. In FIG. 1, face mask 10 comprises a portion of an elastic material (e.g., an elastic nonwoven web), which in the illustrated embodiment is elastic nonwoven sheet 12 having an elongated shape. The elastic nonwoven sheet 12 has a central portion 14 and first and second lateral end portions 16 and 18, respectively, each flanking the central portion 14 on opposite sides. In some embodiments, the central portion 14 may have a length in the transverse direction of up to about 50 to 60 percent and typically at least about 30 or 35 percent of the length of the elastic nonwoven sheet 12 in the transverse direction. The central portion 14 is for wearing over at least a portion of a nose and a mouth of a person and the first and second lateral end portions 16 and 18 are each configured to at least partially extend around opposite sides of a person's face to engage an ear of the person. In the illustrated embodiment, the first lateral end portion 16 may be configured to extend around the left side of a person's face, and the second lateral end portion 18 may be configured to extend around the right side of a person's face. The first lateral end portion 16 has an aperture 17 that can be used to engage a person's ear, and the second lateral end portion 18 has an aperture 19 to engage the person's other ear. In other embodiments, punch-out members can be used instead of apertures 17 and 19, and the punch-out portion of the punch-out member can be removed to form the aperture. The face mask 10 shown in FIG. 1 is viewed from the wearer-facing side of the face mask.

FIG. 2 illustrates a face mask according to and/or made according to the present disclosure viewed from the outward facing surface of the face mask. In FIG. 2, face mask 20 comprises a portion of an elastic material (e.g., a nonwoven web), which in the illustrated embodiment is elastic nonwoven sheet 22 having an elongated shape. The elastic nonwoven sheet 22 has a central portion 24 and first and second lateral end portions 26 and 28, respectively, each flanking the central portion 24 on opposite sides. The central portion 24 is configured for wearing over at least a portion of a nose and a mouth of a person and the first and second lateral end portions 26 and 28 are each configured to at least partially extend around opposite sides of a person's face to engage an ear of the person by means, for example, of apertures 27 and 29. In the illustrated embodiment, the first lateral end portion 26 may be configured to extend around the right side of a person's face, and the second lateral end portion 28 may be configured to extend around the left side of a person's face.

Also shown in the embodiments illustrated in FIGS. 1 and 2 are optional holes 11 and 21 in the portion of the elastic nonwoven web (i.e., elastic nonwoven sheet 12 and 22). Holes 21 may optionally be provided over the entire area of the elastic nonwoven sheet 22, including the central portion 24 and the first and second lateral end portions 26 and 28 as shown in FIG. 2. In some embodiments, holes 11 may be provided only in the first and second lateral end portions 16 and 18 of the elastic nonwoven sheet 12 as shown in FIG. 1. In some embodiments, holes 11 may be provided only in a portion of the first and second lateral end portions 16 and 18. For example, holes 11 may not be provided immediately next to the central portion 14 but may be provided up to distance of at least 0.5 (in some embodiments, at least 0.7, 0.8, 0.9, or 1) centimeters away from the central portion on the first and second lateral end portions 16 and 18. While elastic nonwoven materials typically have some degree of porosity, the optional holes 11 and 21 may be intentionally imparted to the elastic nonwoven sheet 12 and 22 and may have a diameter in a range from about 0.5 millimeter to about 1.5 millimeter. The holes 11 and 21 may be useful, for example, for increasing at least one of the breathability, the elongation, or the comfort of the face mask 10. For example, if the face mask 10 is worn in a hot and/or humid environment, holes 11 provided in the face mask 10 (e.g., in the first and second lateral end portions 16 and 18) may allow the passage of air to improve comfort. Holes 11 in the first and second lateral end portions 16 and 18 spaced away from the central portion 14 may balance the desire for breathability, elongation, or comfort and the desire for a good seal of the face mask 10 around the nose and mouth. In some embodiments, the holes are imparted to the elastic nonwoven sheet 12 and 22 using a spunlace process during the formation of the elastic nonwoven material. In other embodiments, holes may be imparted by die cutting or laser cutting in the same step as the face mask is cut from the layered web in or a previous step using a microreplicated die cutting tool.

The elastic nonwoven sheet can have a color other than white or could have a pattern of multiple colors. Also, as shown in FIG. 2, the elastic nonwoven sheet can be imparted with a graphic. The term "graphic" means any design, shape, pattern, or picture that is visible on the face mask, and specifically includes text (e.g., including one or more alphanumeric symbol), pictorial images that include one or more pictures, and combination thereof. In the illustrated embodiment, a picture is provided in the central portion 24 of the elastic nonwoven sheet on the outward facing surface. The graphic (e.g., picture) can be imparted to the elastic nonwoven sheet through various means such as printing methods (e.g., screen-printing, gravure printing and offset printing) and transfer methods. Color patterns and/or graphics may provide enjoyment for the wearer, for example, when the wearer is a child.

In face masks according to and/or made according to the present disclosure, the central portion and first and second lateral end portions of the elastic nonwoven sheet are formed from the same material and form a unitary structure. In other words, the central portion and first and second lateral end pieces are not formed as three separate pieces that are subsequently joined together. Rather, the central portion and first and second lateral end portions form a continuous structure, the elastic nonwoven sheet 12 and 22. Also, face masks according to and/or made according to the present disclosure typically have a flat (i.e., planar) shape when they are not being worn. The term "flat" means that the any of the multiple web portions (e.g., filtering web portion or second web portion) are substantially parallel (i.e., within 10, 7.5, or 5 degrees of parallel) to a plane defined by the elastic nonwoven sheet. The term "flat" also means that the face masks disclosed herein typically do not have means (e.g., seals, seams, or bonding) to urge the face mask as a whole into a bent or permanently curved or folded position. Face masks according to and/or made according to the present disclosure typically do not have seals or seams in the central portion that define an interior space between the first and second lateral end portions by urging the face mask into a bent or permanently curved or folded position. The generally flat or planar shape of the face mask allows for easy continuous web manufacturing, compact stacking, and easy dispensing of the face masks disclosed herein.

Face masks according to and/or made according to the present disclosure can include face masks of a variety of different sizes. The size of the face mask can be adjusted depending on the user. In some embodiments, the elastic nonwoven sheet (and the face mask) has a maximum dimension of up to 15 (in some embodiments, up to 14, 13, 12, 11, 10, 9, or 8) centimeters (cm) in the longitudinal direction L and up to 36 (in some embodiments, up to 34, 32, 30, 28, 26, 24, 22, or 20) cm in the transverse direction T.

In the embodiment illustrated in FIG. 1, the face mask 10 comprises a filtering web portion bonded along bondline 37 to the central portion 14 of the elastic nonwoven sheet 12. The term "filtering" with respect to the filtering web portion or the filtering web described below refers to separating or removing a portion of the exhalation from the face mask wearer or a portion of the inhalation encountered by the face mask wearer. The filtering web portion or filtering web is typically capable of at least one of providing a barrier to the transmission of pathogenic microorganisms to or from the wearer, trapping allergens (e.g. pollen), trapping particulates, trapping or masking odors, trapping or providing a barrier to liquids, removing cold air (i.e. providing thermal insulation), or reducing viral or bacterial contamination.

Figure 3A:
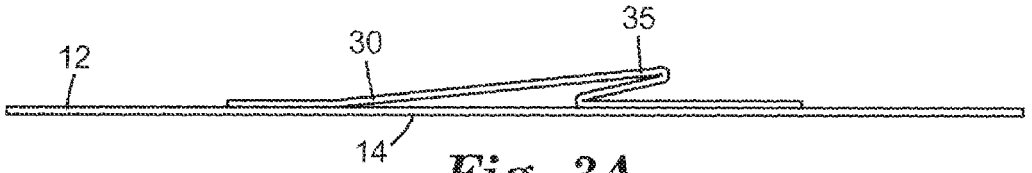
FIG. 3A is an exemplary embodiment of a cross-sectional side view of the face mask in FIG. 1.
Figure 3B:
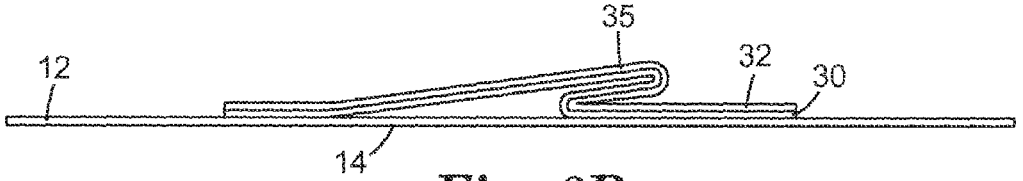
FIG. 3B is another exemplary embodiment of a cross-sectional side view of the face mask in FIG. 1.

The filtering web portion may be seen more clearly in cross-section as shown in FIGS. 3A and 3B. In FIG. 3A, central portion 14 of the elastic nonwoven sheet 12 is bonded to filtering web portion 30. The filtering web portion 30 is typically a partial layer coextensive with the central portion 14 of the elastic nonwoven sheet. Although one filtering web portion 30 is shown, in some embodiments, the face mask disclosed herein may include multiple (e.g., 2, 3, or more) filtering web portions bonded to the central portion 14. The filtering web portion 30 may be on the wearer-facing side of the mask or on the outer facing side of the mask when the face mask is being worn. When more than one filtering web is present, they may be arranged in any order. For example, two filtering webs 30 may be adjacent to each other on either side of the elastic nonwoven sheet 12, or two filtering webs 30 may be on opposite sides of the elastic nonwoven sheet 12.

In the embodiment illustrated in FIG. 3A, the filtering web portion 30 has one pleat 35 so that the central portion 14 may stretch somewhat when the face mask is placed around a person's face, for example, if the partial layer filtering web portion 30 is inelastic or has a significantly lower elongation than the elastic nonwoven sheet. It may be useful as well for the filtering web portion 30 to have more than one pleat (e.g., 2, 3, or more pleats) to allow for stretching of the face mask. The pleats may be placed in any useful configuration, for example, a single pleat can be placed along a longitudinal center line of the face mask. Or a single pleat can be placed between the longitudinal center line and either the first or second lateral end portion. If two pleats are used, they can be placed symmetrically on the mask or not. A first pleat may be between the longitudinal center line and the first lateral end portion, and a second pleat may be between the longitudinal center line and the second lateral end portion. Although pleat 35 is in the longitudinal direction L of the face mask, pleats in the transverse direction T may also be useful. The fold of the pleat 35 may be at least partially bonded to the elastic nonwoven web as shown in FIG. 1, or the fold of the pleat 35 may be unbonded.

Although the pleat shown in FIG. 3A is a single pleat, double pleats or other multiple pleats may also be useful for a face mask disclosed herein in any of the configurations described above. For example, a first set of double pleats may be between the longitudinal center line and the first lateral end portion, and a second set of double pleats may be between the longitudinal center line and the second lateral end portion.

In some embodiments, the pleat or pleats 35 in the filtering web portion 30 are flat pleats made, for example, by folding the filtering web or filtering web portion back on itself a first time and then folding it back on itself a second time as illustrated in FIG. 3A. For double pleats, this folding pattern is usually repeated twice with the same folding direction. For multiple pleats, this folding pattern is usually repeated multiple times. The double pleats or multiple pleats may be overlapping pleats or parallel pleats as desired. In a flat-pleated material, a majority of the pleated material substantially parallel (i.e., within 10, 7.5, or 5 degrees of parallel) to a plane defined by the elastic nonwoven sheet. Flat pleats as shown in FIG. 3A are useful for allowing compact stacking or rolling of the face masks disclosed herein. In contrast, if a filtering web portion is attached to elastic nonwoven sheet 12 by stretch bond lamination, the presence of gathers in the filtering web portion may interfere with compact stacking or rolling of the face masks disclosed herein. Accordingly, in some embodiments, the face mask (or the central portion of the face mask) is not a stretch bonded laminate. As used herein, the term "stretch bonded laminate" refers to a composite material having at least two layers in which one layer is a gatherable layer and the other layer is an elastic layer. The layers are joined together when the elastic layer is extended from its original condition so that upon relaxing the layers, the gatherable layer is gathered. Accordingly, a partial layer of a flat-pleated material having at least one flat pleat would not be a "stretch bonded laminate" because a stretch bonded laminate would not be flat.

In the embodiment illustrated in FIG. 3B, the face mask further comprises a second web portion 32 bonded to the central portion 14 of the portion of the elastic nonwoven web (i.e., elastic nonwoven sheet 12). The elastic nonwoven sheet 12, filtering web portion 30, and second web portion 32 may be arranged in any configuration. In the illustrated embodiment, the second web portion 32 is disposed on the filtering web portion 30 such that the filtering web portion 30 is interposed between the elastic nonwoven sheet 12 and the second web portion 32 (i.e., the second web portion 32 is indirectly bonded to the central portion 14 of the elastic nonwoven sheet 12 with the filtering web portion 30 in between them). In some embodiments, the second web portion 32 may serve as an inner cover layer that is soft against the face. In other embodiments, the second web portion 32 may serve as an outer cover layer that protects the filtering web portion if the filtering web portion is configured to be on the side of the elastic nonwoven sheet 12 facing away from the wearer. In some embodiments, second web portions 32 and/or filtering web portions 30 can be disposed on both sides of the elastic nonwoven sheet 12. In some embodiments, filtering web portion 30 and second web portion 32 may be on opposite sides of the elastic nonwoven web. In some embodiments, the elastic nonwoven sheet 12 forms the surface facing away from the user, one or more filtering web portions 30 are disposed on the central portion of the elastic nonwoven sheet 12 on side facing the user's face, and the second web portion 32 is bonded over the filtering web portion 30 for direct contact with the user's face.

In the embodiment illustrated in FIG. 3B, the second web portion 32 has a length in the transverse direction T that is about the same as that of the filtering web portion 30, both the edges of the second web portion 32 and the filtering web portion 30 are bonded flat to the elastic nonwoven sheet 12 (i.e., without their ends being folded). In some embodiments, the second web portion 32 is longer than the filtering web portion 30 in the transverse direction T. In some of these embodiments, the longitudinal edges of the second web portion may be folded around the longitudinal edges of the filtering web portion before they are bonded to the elastic nonwoven web sheet 12. In other embodiments, the second web portion 32 has a length in the transverse direction T that is about the same as that of the filtering web portion 30, and the longitudinal edges of both the second web portion 32 and the filtering web portion 30 are folded back against themselves before they are bonded to the elastic nonwoven sheet 12.

In some embodiments, the second web portion 32 is a second partial layer of a flat-pleated material. The second web portion 32 and the filtering web portion 30 may have at least one pleat 35, as shown in FIG. 3B, or more than one pleat (e.g., 2, 3, or more pleats) to allow for stretching of the face mask. The pleats may be arranged as described above for the filtering web portion. In some embodiments, the second web portion 32 is elastic. In these embodiments, stretching of the face mask is possible even if the second web portion 32 is not pleated. In some embodiments, the second web portion 32 is not pleated while the filtering web portion 30 is pleated. In some embodiments, the elastic material or elastic nonwoven sheet is pleated (e.g., all three of the elastic nonwoven sheet, the filtering web portion, and the second web portion may be pleated). In the embodiment illustrated in FIG. 3B, the filtering web portion 30 and the second web portion 32 are pleated together. In other embodiments, the filtering web portion 30 and the second web portion 32 may be pleated separately and then positioned on top of each other with the pleats aligned or not aligned as desired. In some embodiments, the second web portion 32 is coextensive with the filtering web portion 30 or filtering web portions and the central portion 14 of the elastic nonwoven sheet 12. In pleated embodiments, the filtering web portion and/or second web portion may be coextensive with the central portion of the face mask while in their pleated configurations.

Figure 8A:
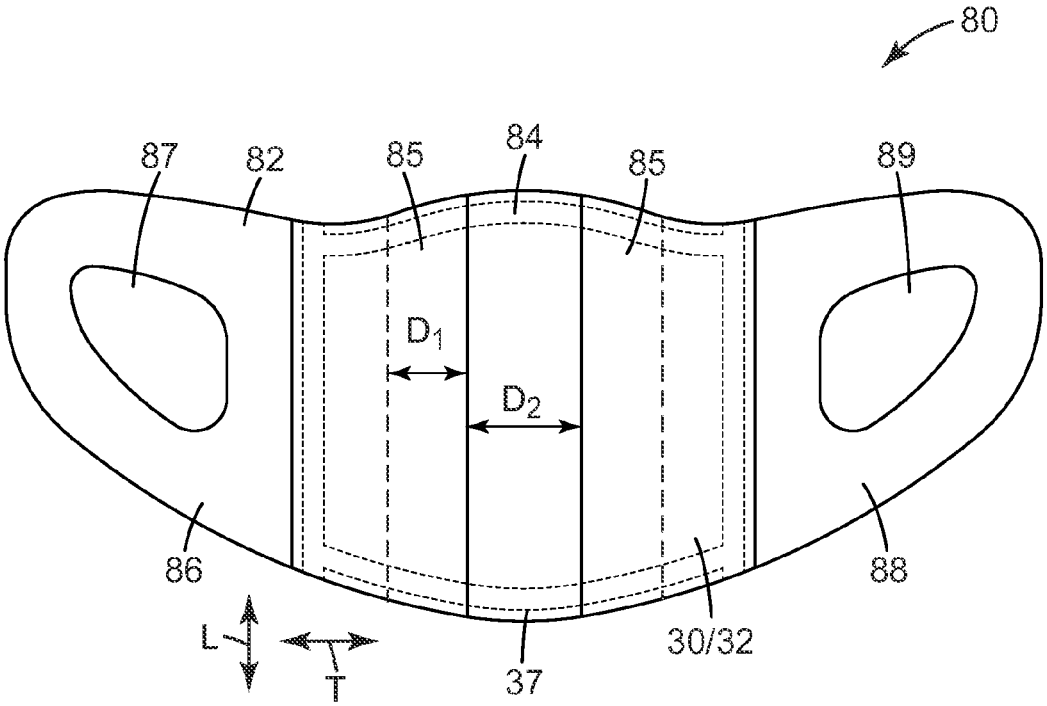
FIG. 8A is a plan view of another exemplary embodiment of a face mask according to and/or made according to the present disclosure, which plan view is of the wearer-facing side.
Figure 8B:
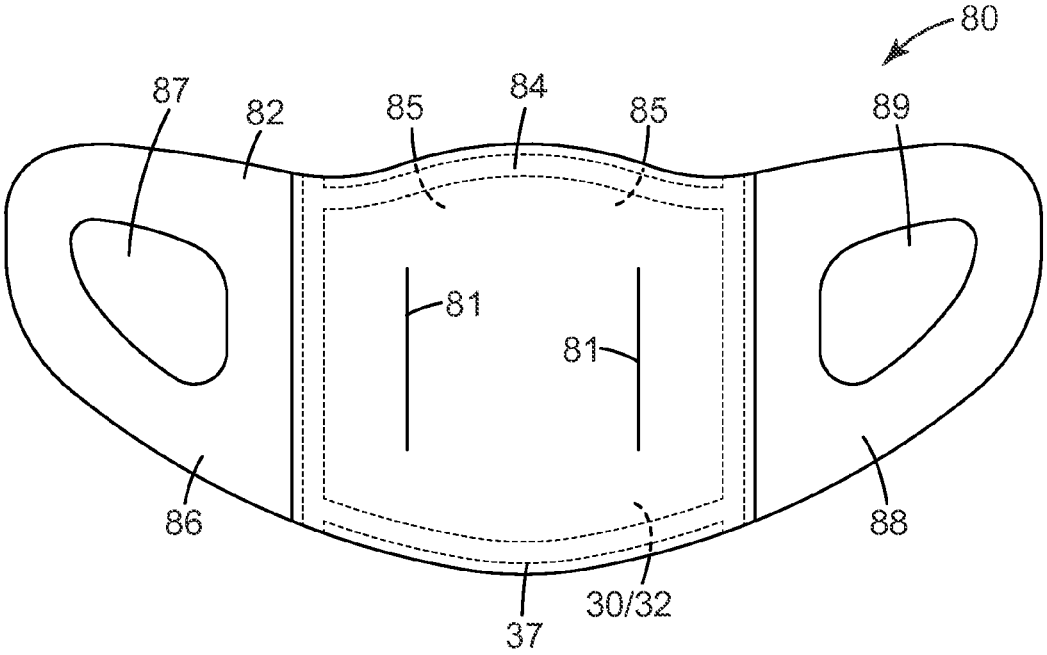
FIG. 8B is a plan view of the outward-facing side of the face mask shown in FIG. 8A.

Another embodiment of a face mask 80 having pleats 85 in the partial layer filtering web portion 30 and optional second web portion 32 is shown in FIGS. 8A and 8B. In FIGS. 8A and 8B, face mask 80 comprises a portion of an elastic material (e.g., elastic nonwoven web), which is elastic nonwoven sheet 82 having an elongated shape. The elastic nonwoven sheet 82 has a central portion 84 and first and second lateral end portions 86 and 88, respectively, each flanking the central portion 84 on opposite sides. The face mask 80 shown in FIG. 8A is shown from the wearer-facing side of the face mask, and FIG. 8B illustrates face mask 80 shown from the outward facing surface of the face mask. The first lateral end portion 86 of face mask 80 has an aperture 87 that can be used to engage a person's ear, and the second lateral end portion 88 has an aperture 89 to engage the person's other ear. The shape of face mask 80 includes curvature along the top edge of the central portion 84 to accommodate a person's nose. The shape of the bottom edge of the central portion 84 can also be shaped to accommodate a person's chin.

As shown in FIG. 8A, face mask 80 has two flat pleats 85 in the filtering web portion 30 and the optional second web portion 32. The pleats 85 are symmetrically positioned in the central portion 84 of the face mask. A first pleat is between the longitudinal center line and the first lateral end portion 86, and a second pleat is between the longitudinal center line and the second lateral end portion 88. The size of the pleats 85 "d1" and the distance between the pleats "d2" can be adjusted depending on desired fit on the face and the size of the typically user. For example, "d2" can vary between about 0 (i.e., the pleats may be positioned adjacent to each other) and about 7.6 cm (3 inches), and "d1" can vary between about 1.27 cm (0.5 inches) and about 5.7 cm (2.25 inches). It may be desirable for the distances "d1" and "d2" to be larger, for example, for a face mask with a central portion having a length in the transverse direction of greater than 14 cm. Pleats 85 may also be double pleats. As in the embodiment illustrated in FIG. 1, filtering web portion 30 and optional second web portion 32 are bonded along bondline 37 to the central portion 84 of the elastic nonwoven sheet 82.

Also shown in the embodiment illustrated in FIG. 8*b* are optional cuts 81 in the portion of the elastic nonwoven web (i.e., elastic nonwoven sheet 82). The term "cut" is intended to include cuts in the web that do not remove material (i.e., slits) and cuts in the web that remove material (i.e., holes). Cuts 81 (slits as shown) may advantageously be placed in the vicinity of pleats 85 in the filtering web portion 30 and the optional second web portion 32. The cuts 81 may allow the pleats 85 to extend through openings in the elastic nonwoven sheet 82 formed from the cuts 81 when the face mask is stretched and worn. In this way, more space can be created by the pleats to accommodate the user's facial features (e.g., nose and mouth). Double pleats in this configuration (e.g., wherein each of pleats 85 are overlapping double pleats) may allow for increased adjustment of the space created for a wearer's facial features. Pulling on the pleats through the cuts 81, for example, may open up more space around a wearer's nose if desired. The cuts 81 may be made to be positioned directly over the pleats 85 although this is not a requirement. When the cuts 81 are positioned directly over the pleats 85, they may be centrally positioned on the folds of the pleats 85 or they may be offset. Also, the cuts 81 may be centrally positioned longitudinally on the face mask 80, or they may be offset. The cuts 81 may be in the form of straight lines as shown in FIG. 8B or they may be zigzagged or curved (e.g., arc or S-shaped). It is useful for the cuts 81 to be long enough for at least a portion of the pleats 85 to protrude through the elastic nonwoven sheet 82 when the face mask 80 is worn. For example, the cuts may have a length that is about 10 percent to 100 percent (in some embodiments, 10 percent to 99 percent, 30 percent to 95 percent, or 50 percent to about 90 percent) of the longitudinal dimension of the face mask. Although in the illustrated embodiments, two cuts 81 are shown, the central portion of the elastic nonwoven sheet may be provided with at least one cut (e.g., 2, 3, or more cuts). The number of cuts may correspond with the number of pleats. In other embodiments, the cuts may not be associated with any pleats (e.g., the cuts may be useful in a face mask that is not even pleated), and the cuts may be in any desirable position. In some embodiments, it may be useful to position a cut in the elastic nonwoven sheet in the longitudinal direction L in the central portion at or near the longitudinal center line, for example, to allow more space for a wearer's nose. Slits or holes can be made in the elastic web before it is bonded to the filtering web or during the stamping of the face mask using the methods described below, for example.

The method of making a face mask according to the present disclosure involves bonding a filtering web and optionally a second web to a center lane of an elastic nonwoven web to form a layered web and subsequently stamping a face mask into the layered web. The layered web may be of any size, and the plurality of face masks 10 may be stamped therefrom in any number, shape, or size (e.g., including the sizes mentioned previously). The elastic nonwoven web, the filtering web and the second web are typically all continuous in the machine direction. The central lane of the continuous elastic nonwoven web has a cross-web width that is less than the cross-web width of the continuous elastic nonwoven web. The central lane is not aligned with first or second longitudinal edges of the continuous elastic nonwoven web, and, in some embodiments, is centered around a longitudinal center line of the continuous elastic nonwoven web. The cross-web width of the center lane may be up to about 50 or 60 percent and is typically at least about 30 or 35 percent of the cross-web width of the elastic nonwoven web. The filtering web typically has a cross-web width that is substantially the same (e.g., within about 10, 7.5, or 5 percent) as the cross-web width of the central lane. In some embodiments of the face masks according to the present disclosure, the elastic nonwoven sheet is a portion formed from of the elastic nonwoven web, the filtering web portion is formed from the filtering web, and the optional second web portion is formed from the optional second web. In some embodiments, the method comprises intermittently slitting the elastic nonwoven web so that at least one cut is provided in the central portion of the face mask.

In the method disclosed herein, the face mask is stamped from the layered web so that the central portion is stamped from the central lane of the continuous elastic nonwoven web and first and second lateral end portions each flank the central portion on opposite sides. This configuration of the face masks on the web allows for continuous bonding of the filtering web and optionally the second web to the elastic nonwoven web, for example, in the machine direction. A wide variety of bonding techniques may be useful for bonding the filtering web and optionally the second web to the elastic nonwoven web. Exemplary bonding techniques include ultrasonic welding, thermal bonding (e.g., thermal point bonding), adhesive bonding, laminating, stitch bonding, melting bonding, needle punching, and hydro-entangling.

In some embodiments, the method of making a face mask according to the present disclosure further comprises pleating the filtering web so that the filtering web has at least one (in some embodiments, 2, 3, or more) machine direction pleat. The pleat or pleats in the filtering web may be positioned with respect to the longitudinal center line of the elastic nonwoven web as described above. When a pleated filtering web or filtering web portion is said to have the same cross-web width or to be coextensive with the central portion of the elastic nonwoven web or sheet, respectively, it is the width of the filtering web or filtering web portion after pleating that is being referred to. As described above, the pleats may be flat pleats to facilitate the continuous process of bonding the filtering web to the elastic nonwoven web and stamping the face masks into the layered web. In some embodiments, the layered web is not a stretch bonded laminate, which would form multiple gathers in the filtering web. The fold of the at least one pleat may be bonded or not bonded. In some embodiments, the fold of the at least one pleat is bonded along the top edge and bottom edge of the face mask. In some of these embodiments, the at least one pleat is not bonded between the top edge and bottom edge of the face mask. In some of these embodiments, the central portion of the elastic nonwoven web is not extensible along the top and bottom edges of the face mask but is extensible between the top and bottom edges of the face mask.

In some embodiments of the method according to the present disclosure, the method further includes providing a second web continuous in the machine direction and having a cross-web width that is substantially the same (e.g., within about 10, 7.5, or 5 percent) as the cross-web width of the central lane and the filtering web and bonding the second web to the central lane of the elastic nonwoven web to provide a layered web. In some embodiments, the second web is longer than the filtering web in the cross-web direction. In some of these embodiments, the longitudinal edges of the second web may be folded around the longitudinal edges of the filtering web before they are bonded to the elastic nonwoven web. In other embodiments, the second web has a length in the cross-web direction that is substantially the same as that of the filtering web, and the longitudinal edges of both the second web and the filtering web are folded back against themselves before they are bonded to the elastic nonwoven web. In some of these embodiments, the second web is elastic. In some embodiments, the method of making a face mask according to the present disclosure further comprises pleating the second web so that the second web has at least one machine direction pleat. The pleat or pleats may have the same configuration as the filtering web described above.

While the filtering web and optional second web may be pleated, generally the method of making a face mask according to the present disclosure does not include folding the elastic web, filtering web, and/or second web in half or in other portions (e.g., thirds) during web processing.

Figure 9:
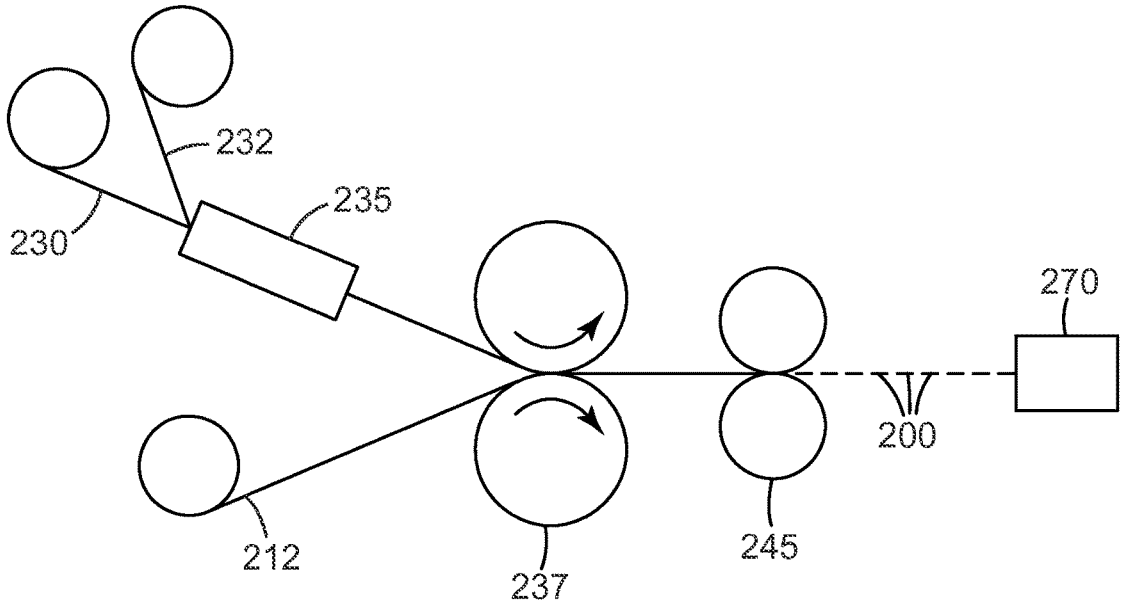
FIG. 9 is a schematic illustration of an exemplary method of making a face mask according to the present disclosure.

A schematic illustration of an embodiment of a method of making a face mask according to the present disclosure is illustrated in FIG. 9. In the illustrated embodiment, second web 232 and filtering web 230 are together fed into a pleating station 235 where they are provided with a desired pleat configuration. Elastic web 212, which in some embodiments is intermittently cut in the machine direction, is joined to the filter web 230 and second web 232 in bonding station 237, which can employ any of the bonding methods described above. After bonding, the joined web is passed through a die cutting station 245 to provide individual face masks 200, which may be packaged as desired in stacking and packaging station 270.

For face masks according to and/or made according to the present disclosure, the first lateral end portion, the second lateral end portion, and the central portion of the elastic nonwoven sheet may all be integrally formed with one another and stamped from the continuous elastic nonwoven web in one piece. Stamping includes cutting the layered web, for example, with continuous cuts or with discontinuous cuts (e.g., perforations). The cuts (e.g., continuous or discontinuous cuts) may be made, for example, using die cutting (e.g., rotary die cutting) or laser cutting. When the face mask is stamped from the layered web, it may have a first opening in the first lateral end portion and a second opening in the second lateral end portion, or it may have a first punch out member in the first lateral end portion and a second punch out member in the second lateral end portion. Referring again to FIG. 1, in some embodiments, the first lateral end portion 16 and the second lateral end portion 18 are each stamped with punch out members that become apertures 17 and 19, respectively. Removal of the punch out members may be done after the user has obtained the face mask 10, or may be done at a later stage of manufacturing prior to eventual purchase and use by the user. In some embodiments, aperture 17 is die cut into the first lateral end portion 16, and aperture 19 is die cut into the second lateral end portion 18 simultaneously with the die cutting of the face mask 10. Optional holes 11 may also be formed into at least a portion of the elastic nonwoven web simultaneously with the stamping (e.g., die cutting) of the face mask 10. Alternatively, the layered web or elastic nonwoven web may be processed with a microreplicated cutting tool to form holes in at least a portion of the web before the elastic nonwoven web is bonded to the filtering web and optionally the second web.

The continuous web manufacturing of the plurality of face masks described above is advantageous in that separate manufacturing steps are reduced or eliminated. Continuous web manufacturing is possible because the central portion and first and second lateral end portions can be formed simultaneously during the stamping process. Furthermore, the configuration of the face masks is such that a filtering web, an elastic nonwoven web, and an optional second web that are continuous in the machine direction may be used. The filtering web and the second web may be bonded simultaneously to the elastic nonwoven web, and the face mask can be subsequently stamped in one step.

For the methods and face masks disclosed herein, the elastic web or a portion thereof (e.g., the elastic layer) is made from soft, flexible material or materials that allow the face mask according to and/or made according to the present disclosure to be readily dispensed. Typically, the elastic material is an elastic nonwoven material. The elastic nonwoven sheet is a resilient material so that the first or second lateral end portion, for example, can be grasped by hand and pulled from a dispenser without deforming or tearing the elastic nonwoven sheet. In some embodiments, for example, in a stack of interfolded face masks, the elastic nonwoven sheet does not permanently crease or crinkle. Similarly, the filtering web or portion thereof and/or the second web or portion thereof may be made from soft, flexible materials.

The elastic web (e.g., nonwoven web) or portion thereof (e.g., the elastic nonwoven sheet or elastic layer) is able to stretch in one or more directions. In some embodiments, the elastic nonwoven sheet has an elongation of at least 5 (in some embodiments, at least 10, 25, 40, 50, 75, or 100) percent and up to about 150, 200, 250, 300, 350, or 500 percent in at least one direction. The elongation in terms of percent stretch is {(the extended length−the initial length)/the initial length} multiplied by 100. For example, if a material having an initial length of one (1) cm can be stretched 0.50 cm, that is, to an extended length of 1.50 cm, the material can be said to have an elongation of 50 percent. In some embodiments, the elastic nonwoven sheet or elastic layer can stretch in both the transverse direction T and the longitudinal direction L (referring to FIGS. 2 and 8A). In some embodiments, all of the first and second lateral end portions and the central portion can be stretched in one or more directions. The ability of the elastic nonwoven sheet or elastic layer to stretch in at least one of the transverse or longitudinal directions will typically allow for fuller coverage of the wearer's face and provide for more flexibility in accommodating variously sized faces of users. In particular, transverse and/or longitudinal stretching in the central portion will typically allow for better fitting on the face.

The elastic material (e.g., the elastic nonwoven sheet or layer) also exhibits recovery from stretching. Recovery refers to a contraction of a stretched material upon termination of a biasing force following stretching of the material by application of the biasing force. For example, if a material having a relaxed, unbiased length of one (1) cm is elongated 50 percent by stretching to a length of 1.5 cm and subsequently contracts to a length of 1.1 cm after release of the stretching force, the material would have recovered 80 percent (0.4 cm) of its elongation. The elastic nonwoven sheet or layer may have a recovery of, for example, at least 25, 50, 60, 70, 75, or 80 percent.

In some embodiments of the face masks according to and/or made according to the present disclosure, the filtering web portion is bonded to the central portion in a manner such that the central portion of the elastic nonwoven portion or sheet has a reduced elongation in at least one direction relative to the first and second lateral end portions. In these embodiments, the filtering web portion is inelastic or has a lower elongation than the elastic nonwoven portion or sheet. In some of these embodiments, the central portion of the elongated elastic nonwoven portion or sheet has an elongation of less than fifteen (in some embodiments, up to 14, 13, 12, 11, or 10) percent in at least one of the longitudinal L or transverse T direction. In other of these embodiments, at least part of the central portion of the elongated elastic nonwoven portion or sheet has an elongation of at least 70 (in some embodiments, at least 75, 80, or 85) percent and up to about 160, 150, 125, 110, or 100 percent in the transverse T direction. The longitudinal direction L corresponds to the machine direction, and the transverse direction T corresponds to the cross web direction. In some embodiments, different portions of the central portion may have different elongations in the same direction. For example, at the top and bottom edges, in the central portion of the elongated nonwoven sheet, the elongation may be up to 5 (in some embodiments, 4, 3, 2, or 1) percent in the transverse direction while between the top and bottom edges, the elongation may be greater than 5 and up to 15 (in some embodiments, up to 14, 13, 12, 11, or 10) percent in the transverse direction. In other embodiments, at the top and bottom edges, in the central portion of the elongated nonwoven sheet, the elongation may be up to 5 (in some embodiments, 4, 3, 2, or 1) percent in the transverse direction while between the top and bottom edges, the elongation may be at least 70 (in some embodiments, at least 75, 80, or 85) percent in the transverse direction. Reduced elongation at the top and bottom edges may be useful, for example, for providing a good seal against the user's face. In some embodiments, the central portion of the elongated elastic nonwoven sheet has an elongation of less than ten (in some embodiments, up to 7.5, 5, 2.5, 2, or 1) percent in the longitudinal L direction. In some embodiments, the first lateral end portion and the second lateral end portion each have an elongation of at least 15 (in some embodiments, at least 20, 25, 30, 40, 50, 75, 90, or 100) percent and up to about 500 (in some embodiments, up to 350, 300, 250, or 200) percent in at least one of the longitudinal L or transverse T direction. The amount of elongation in the central portion or central lane can be controlled, for example, by the choice of materials (e.g., for the elastic nonwoven web, the filtering web, and the second web), the extent of attachment of the filtering web portion and the central portion, and the size and number of pleats used when attaching the central portion to the filtering web portion. Limiting the elongation of the central portion may allow for better filtration properties. For example, when porous elastic materials (e.g., elastic nonwoven webs) are stretched, large spaces may be opened in the materials that allow contaminants to pass through. On the other hand, more elongation in the central portion may allow for better fit on the face.

Various types of nonwoven materials may provide useful elastic nonwoven webs or portions thereof (e.g., sheets). In some embodiments, the elastic nonwoven web or portion thereof comprises a spunbonded, meltblown, or spunlace nonwoven. The term "spunbonded" refers to small diameter fibers which are formed by extruding molten thermoplastic material as filaments from a plurality of fine, usually circular capillaries of a spinneret with the diameter of the extruded filaments then being rapidly reduced to fibers. Spunbond fibers are generally continuous and have diameters generally greater than about 7 microns, more particularly, between about 10 and about 20 microns. The term "meltblown" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Meltblown fibers are generally microfibers which may be continuous or discontinuous with diameters generally less than 10 microns. Spunlacing uses high-speed jets of water to strike a web to intermingle the fibers of the web. Spunlacing is also known as hydroentangling and can be carried out on fibrous webs made, for example, using carded webs and air-laid webs.

Exemplary useful materials for making the elastic nonwoven web or portion thereof (e.g., sheet) include thermoplastic elastomers such as ABA block copolymers, polyurethane elastomers, polyolefin elastomers (e.g., metallocene polyolefin elastomers), polyamide elastomers, ethylene vinyl acetate elastomers, and polyester elastomers. An ABA block copolymer elastomer generally is one where the A blocks are polystyrenic, and the B blocks are conjugated dienes (e.g., lower alkylene dienes). The A block is generally formed predominantly of substituted (e.g, alkylated) or unsubstituted styrenic moieties (e.g., polystyrene, poly(alphamethylstyrene), or poly(t-butylstyrene)), having an average molecular weight from about 4,000 to 50,000 grams per mole. The B block(s) is generally formed predominantly of conjugated dienes (e.g., isoprene, 1,3-butadiene, or ethylene-butylene monomers), which may be substituted or unsubstituted, and has an average molecular weight from about 5,000 to 500,000 grams per mole. The A and B blocks may be configured, for example, in linear, radial, or star configurations. An ABA block copolymer may contain multiple A and/or B blocks, which blocks may be made from the same or different monomers. A typical block copolymer is a linear ABA block copolymer, where the A blocks may be the same or different, or a block copolymer having more than three blocks, predominantly terminating with A blocks. Multi-block copolymers may contain, for example, a certain proportion of AB diblock copolymer, which tends to form a more tacky elastomeric film segment. In some embodiments, the elastic nonwoven sheet useful for practicing the present disclosure is made from a variety of useful materials (e.g., polypropylene, polypropylene-polyethylene copolymers, and thermoplastic polyurethanes). In some embodiments, the elastic nonwoven web is made, for example, from multi-component (e.g., bi-component such as core-sheath) fibers. In some embodiments, the elastic nonwoven web is a multi-layer laminate of different materials (e.g., the materials described above) in the layers. For example, the elastic nonwoven web may comprise a layer of meltblown fibers between two layers of spundonded fibers.

Materials can be selected for the elastic nonwoven portion or sheet, for example, depending on how they feel against the skin. The elastic nonwoven sheet can be made from materials that feel soft against the skin. The elastic nonwoven sheet can also be made from materials that have a rubbery feeling so that they can stay in place.

Several materials useful for making the elastic nonwoven sheet are commercially available, for example, polyolefins from ExxonMobil, Houston, Tex., under the trade designation "VISTAMAXX" and thermoplastic polyurethane elastomers from Huntsman, The Woodlands, Texas, under the trade designation "IROGRAN". In some embodiments, the elastic nonwoven sheet comprises a marnix nonwoven material. In some embodiments, the elastic nonwoven sheet comprises a spunbond nonwoven available from Idemitsu Kosan Co., Ltd., Tokyo, Japan, under the trade designation "STRAFLEX".

A variety of materials are also useful for making the filtering web or portion thereof. In some embodiments, the filtering web is also a nonwoven (e.g., a polypropylene nonwoven material). In some embodiments, the filtering web is a microreplicated perforated film. The filtering web may also include multiple layers of nonwoven materials or microreplicated perforated films. In some embodiments, the filtering web is electrically charged. Charged filtration medium typically increases filtration efficiency by drawing particles to be filtered toward the filter by virtue of their electrical charge. In some embodiments, the filtering web is an electret. Electret treatment can be carried out by a number of different techniques (e.g., those described in U.S. Pat. Nos. 5,401,446 (Tsai et al.); Pat. No. 4,215,682 (Kubik et al.); Pat. No. 4,375,718 (Wadsworth); Pat. No. 4,592,815 (Nakao); and Pat. No. 4,874,659 (Ando), the disclosures of which are incorporated herein by reference in their entirety. In some embodiments, the filtering web or portion thereof and/or the face mask has a filtering efficiency of at least 99 (in some embodiments, 98, 97, 96, or 95) percent.

In some embodiments, the filtering web or filtering web portion is useful, for example, for protecting the face mask wearer from unpleasant odors. In some of these embodiments, the filtering web is loaded with activated carbon or other particles. In some of these embodiments, the filtering web may include two or more layers of material, for example, in the form of a pad. The filtering web may be a nonwoven web with the particles uniformly dispersed throughout the nonwoven using conventional techniques. Or the filtering web may be formed with the particles embedded in the nonwoven, for example, an activated carbon fiber nonwoven available, for example, from Kuraray Chemical Co., Osaka, Japan. In other embodiments, the filtering web is provided with a fragrance (e.g., for masking the unpleasant odors).

In some embodiments, the filtering web or portion thereof is a nonwoven web of microfibers that are thermally insulating. For example, the filtering web may comprise a mixture of microfibers and crimped staple fibers as described in U.S. Pat. No. 4,118,531 (Hauser), the disclosure of which is incorporated herein by reference in its entirety. In some of these embodiments, the filtering web may include two or more layers of material, for example, in the form of a pad.

In some embodiments, the filtering web or portion thereof comprises an antiviral, antibacterial, or antifungal agent. Suitable agents of this type include citric acid, boric acid, and silver oxide. In some of the embodiments, the filtering web comprises a nonwoven web onto which the antiviral, antibacterial, or antifungal agent is applied (e.g., by rolling or spraying as described, e.g., in U.S. Pat. No. 4,856,509 (Lemelson)). The antiviral, antibacterial, or antifungal agents may be useful for killing airborne pathogens and for pathogens in bodily fluids or other liquids that may come into contact with the mask.

In some embodiments, the filtering web portion or the filtering web is microfiber insulation available from 3M Company, St. Paul, Minn., under the trade designation "THINSULATE".

In some embodiments, the filtering web portion or the filtering web provides a barrier to liquids, for example, by virtue of having a low-surface-energy coating on at least one surface or a low-surface-energy material embedded in the web. The low-surface-energy coating or material can be provided, for example, with a wax, a silicone, or fluorochemical additive. Suitable fluorochemical additives include those described in U.S. Pat. No. 5,025,052 (Crater et al.), U.S. Pat. No. 5,099,026 (Crater et al.), U.S. Pat. No. 5,706,804 (Baumann et al.), and U.S. Pat. No. 6,127,485 (Klun et al.). Filtering webs providing a barrier to liquids (i.e., fluid resistance) may be useful, for example, for a surgical mask.

While some filtering web portions may be designed to have multiple functions, face masks according to the present disclosure may include two different filtering web portions, with each filtering web portion having the same or different functionality. For example, the face mask may include both a first filtering web portion that is charged to remove particulates and a second filtering web portion that is designed to provide thermal insulation. In some embodiments, the face mask may include both a first filtering web portion that is charged to remove particulates and a second filtering web portion that is treated with an antiviral, antibacterial, or antifungal agent. In another embodiment, the face mask includes both a first filtering web portion that is charged and a second filtering web portion that is designed to provide fluid resistance. In some of these embodiments, the filtering web portion providing fluid resistance may be positioned adjacent the elastic nonwoven sheet. In some of these embodiments, the elastic nonwoven sheet 82 may have slits 81 as shown in FIG. 8B and described above. To make face masks according to these embodiments, two different filtering webs with the desired functionality may be used in the method of making a face mask according to the present disclosure.

A variety of materials are also useful for making the optional second web or portion thereof. In some embodiments, the second web is also a nonwoven (e.g., made from polypropylene, polypropylene-polyethylene copolymers, or natural fibers). In some embodiments, the second web is a microreplicated perforated film (e.g., made of polypropylene). The second web may also include multiple layers of nonwoven materials or microreplicated perforated films. In some embodiments, the second web is a nonwoven web (e.g., a spunbonded, meltblown, or coform nonwoven web, or a bonded carded web). The term "coform" means a meltblown material to which at least one other material (e.g., pulp or staple fibers) is added during the meltblown web formation. In some embodiments, the second web or portion thereof is made of the same material as the elastic nonwoven web. In some embodiments, the second web is a necked nonwoven web or a reversibly necked nonwoven web. The necking process typically involves unwinding a material from a supply roll and passing it through a brake nip roll assembly at a given linear speed. A take-up roll or nip, operating at a linear speed greater than that of the brake nip roll, draws the material and generates the tension needed to elongate and neck the fabric. When a reversibly necked material is desired, the stretched material is heated and cooled while in a stretched condition. The heating and cooling of the stretched material causes additional crystallization of the polymer and imparts a heat set. When the necked material is bonded to the elastic nonwoven sheet, it can extend and retract with the elastic nonwoven sheet. In some embodiments, the second web or portion thereof is a low density (e.g., 10 to 30 grams per square meter) spunbond polypropylene.

Face masks according to and/or made according to the present disclosure may comprise two second webs or second web portions on either side of the filtering web or filtering web portion. This construction may be useful, for example, when a carbon-loaded or thermally insulating pad having multiple layers is used as the filtering web or filtering web portion. In these embodiments, each second web or portion thereof may be made of the same or different materials including any of the materials described above. In some embodiments, each second web or portion thereof is a low density spunbond polypropylene.

In some embodiments, the second web or portion thereof may be provided with a fragrance or scented oil. For example, the second web or portion thereof may be treated with a mint or wintergreen fragrance or oil to soothe or comfort the user. In some of these embodiments, there may be an untreated second web portion that is positioned to contact the user's skin while a second web portion provided with a fragrance may be positioned such that it does not contact the user's skin.

In some embodiments, at least one second web or second web portion may be made of a malleable material. This may be useful, for example, to allow the face mask to hold a desired shape when it is worn. For example, in embodiments where a combination of slits and pleats is used to provide space for a user's facial features, a second web portion of a malleable material can serve to hold open this space. In some of these embodiments, there may be a soft, flexible second web portion that is positioned to contact the user's skin while a second web portion of a malleable material may be positioned such that it does not contact the user's skin.

Face masks according to and/or made according to the present disclosure may also include an adhesive tape or an adhesive strip, which may be a patterned adhesive, disposed on at least one of a top or a bottom edge of the face mask. The adhesive strip (e.g., patterned adhesive) may be coated or printed onto the face mask on at least one of a top or bottom edge using, for example, rotary print coating. An adhesive tape strip may also be placed on the face mask in the desired location(s). The adhesive tape or adhesive strip can be disposed on at least one of a top or bottom edge of the filtering web portion, at least one of a top or bottom edge of the second web portion, or at least one of a top or bottom edge of the central portion of the elastic nonwoven sheet. In some embodiments, the adhesive tape strip is adhered to a second web portion on the face side of the face mask. The adhesive tape strip may be useful, for example, to provide a better fit of the central portion over the nose, cheeks, or chin of the wearer. A better fit may enhance the ability of the face mask to prevent the transfer of pathogens through any gaps between the face mask and the face. The adhesive tape strip may include, for example, a pressure sensitive adhesive (PSA) that is physically and biologically compatible with human skin, which PSA may be coated on a nonwoven fabric (e.g., a hydroentangled or needle-tacked polyester or rayon nonwoven). Suitable skin-compatible pressure sensitive adhesives include acrylic based adhesives, polyolefin adhesives, rubber-based adhesives, and tackified styrene block copolymer adhesives. For convenient packaging, removable liners may be provided on the adhesive tape or strip. Some useful skin-compatible adhesive tapes with removable liners are commercially available, for example, a nonwoven cloth carrier double coated tape available from 3M Company, St. Paul, Minn., under the trade designation "3M DOUBLE-COATED SPUNLACE NONWOVEN TAPE 9917".

Face masks according to and/or made according to the present disclosure may also include an elongated malleable member disposed on at least one of a top or a bottom edge of the face mask. The malleable member may be placed on the outside surface of the face mask facing away from the wearer in the central portion of the elastic nonwoven sheet or, in a multi-layer construction, may be in between any of the layers (e.g., the filtering web portion and the second web portion or the filtering web portion and the elastic nonwoven sheet). The malleable member may be useful, for example, to provide a better fit of the central portion over the nose, cheeks, or chin of the wearer. Exemplary suitable malleable members include a metal wire or an aluminum band.

Face masks according to and/or made according to the present disclosure may also include a removable pad, which may be useful, for example, for providing additional desirable features to the face mask. For example, when a soothing fragrance is desired a pad treated with a mint or wintergreen fragrance or oil can be inserted into one of cuts 81 in the embodiment illustrated in FIG. 8B. When the fragrance is no longer effective or no longer desired, the pad can be easily removed from the face mask through one of the cuts 81.

Figure 4A:
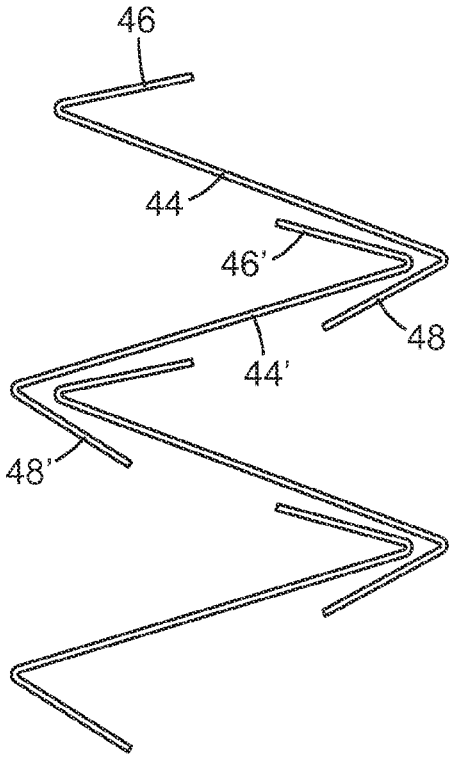
FIG. 4A is a schematic representation of an exemplary interfolding configuration of a plurality of face masks according to the present disclosure.
Figure 4B:
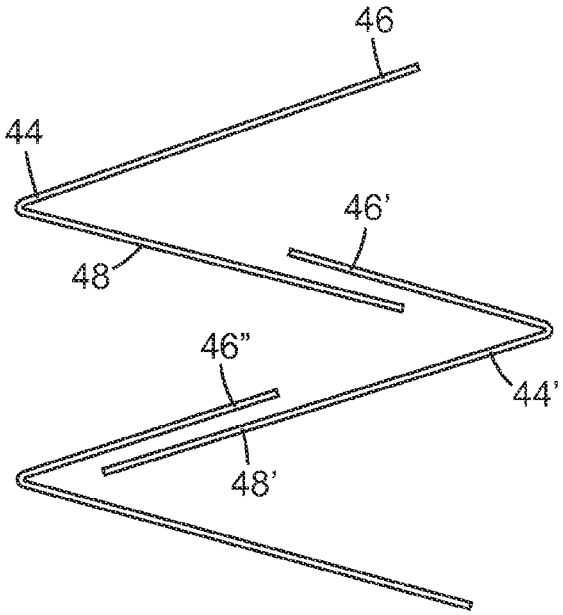
FIG. 4B is a schematic representation of another exemplary interfolding configuration of a plurality of face masks according to the present disclosure.
Figure 4C:
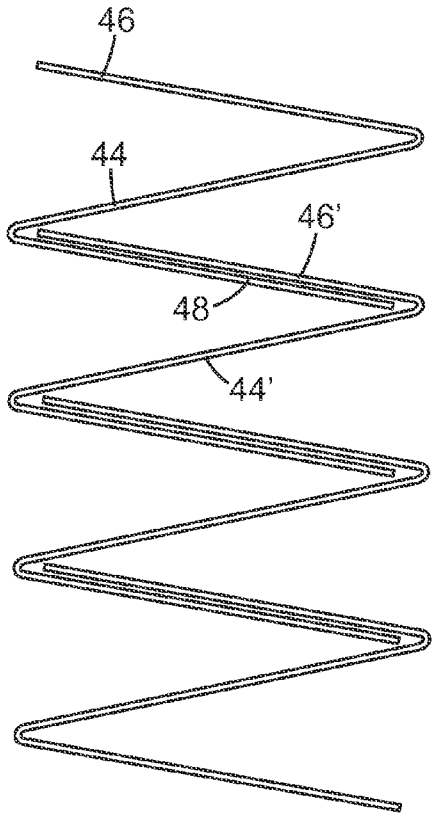
FIG. 4C is a schematic representation of yet another exemplary interfolding configuration of a plurality of face masks according to the present disclosure.
Figure 4D:
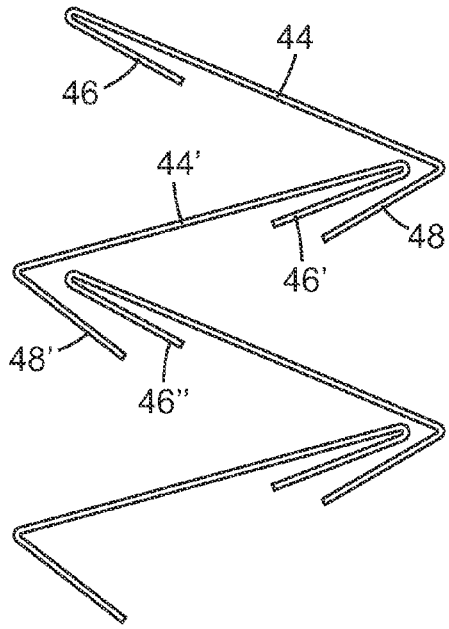
FIG. 4D is a schematic representation of yet another exemplary interfolding configuration of a plurality of face masks according to the present disclosure.
Figure 4E:
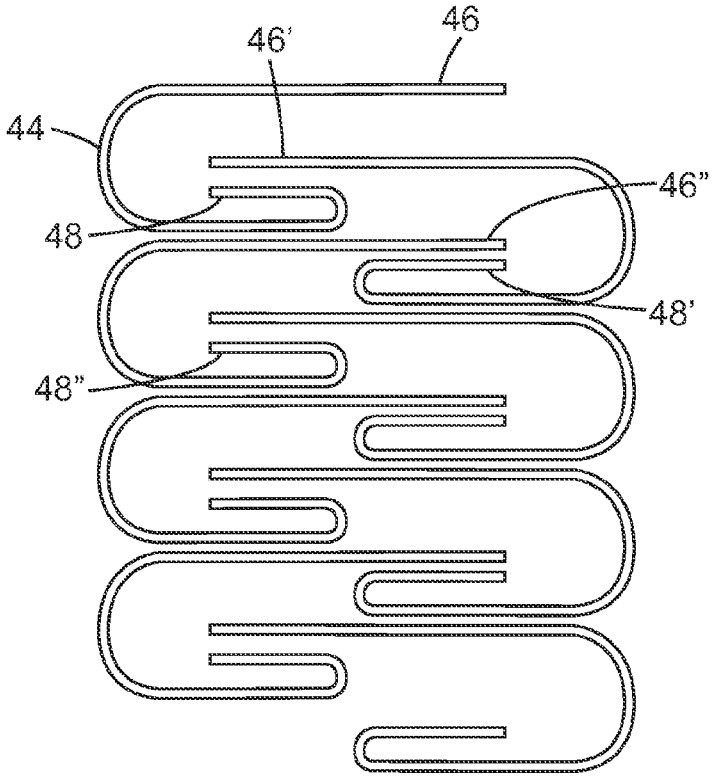
FIG. 4E is a schematic representation of yet another exemplary interfolding configuration of a plurality of face masks according to the present disclosure.

The face masks according to and/or prepared according to the present disclosure can be made dispensable using a variety of techniques. In some embodiments, a plurality of face masks according to and/or made according to the present disclosure are included in a stack of interfolded face masks comprising a first face mask and a second face mask, wherein the second lateral end portion 48 of the first face mask is interfolded with the first 46' or second 48' lateral end portion of the second face mask. The first lateral end portion 46 is typically available to be grasped and removed from the stack (e.g., in a dispenser). Some exemplary interfolding configurations are shown in FIGS. 4A, 4B, 4C, 4D, 4E, and 4F. FIGS. 4A and 4C illustrate different types of Z-folding. FIG. 4B illustrates a so-called V-fold or U-fold. FIGS. 4D and 4E illustrate C-folding configurations. When the second lateral end portion of the first face mask is interfolded with the first or second lateral end portion of the second face mask, it may be understood that the second lateral end portion of the first face mask overlaps with the first or second lateral end portion of the second face mask. In FIGS. 4B and 4C, the second lateral end portion 48 of the first face mask overlaps with the first lateral end portion 46' of the second face mask in a direct face-to-face arrangement. In FIGS. 4A and 4D, the first lateral end portion 46' of the second face mask is first folded on itself and nested into the folded second lateral end portion 48 of the first face mask. Likewise, the second lateral end portion 48' of the second face mask is interfolded with the first lateral end portion 46" of the next face mask in the stack. In FIG. 4E, the second lateral end portion 48 of the first face mask is first folded on itself and interfolded with the unfolded first lateral end portion 46' of the second face mask. In this configuration, only the second lateral end portions 48, 48', and 48" are folded onto themselves while the first lateral end portions 46, 46', and 46" remain unfolded. In the embodiment illustrated in FIG. 4E, the folded second lateral end portions 48, 48', and 48" do not overlap each other. In other embodiments, the face masks can be positioned so that the folded second lateral end portions overlap. In any of the folding configurations, the central portions 44, 44' may be folded, for example, as illustrated in FIGS. 4B and 4E. Or the central portions 44, 44' may not have folds, for example, as illustrated in FIGS. 4A, 4C, and 4D.

Figure 4F:
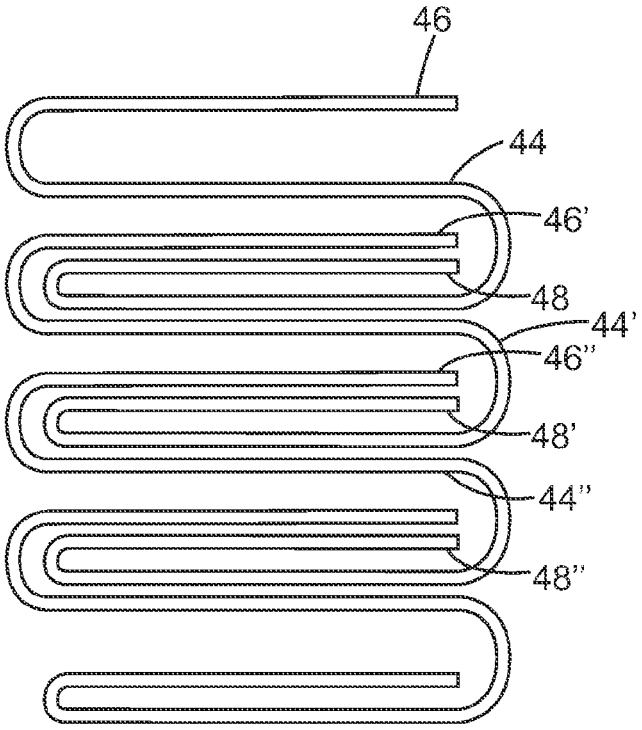
FIG. 4F is a schematic representation of yet another exemplary interfolding configuration of a plurality of face masks according to the present disclosure.

In FIG. 4F, the stack of interfolded face masks has a modified S-fold configuration. In this configuration, each face mask includes three folds. In the other configurations shown in FIGS. 4A-4E, the stack of interfolded face masks typically contains one or two folds. The second lateral end portion 48 of the first face mask is first folded onto the central portion and interfolded with a fold in the second face mask made by the overlapping of part of the central portion 44' and the first lateral end portion 46'. Each face mask has a fold in the central portion 44, 44', and 44" that accounts for the third fold in the mask. In the embodiment illustrated in FIG. 4F, each of the folded second lateral end portions 48, 48', and 48" are positioned one above the other in the stack although this is not a requirement. Advantageously, the folding configuration shown in FIG. 4F allows for face masks to be removed one-at-a-time from a compact dispenser (e.g., where the length of the shorter pair of sides 52 in FIG. 5B is up to one-third the length of the face mask in the transverse direction). In these embodiments, the length of the shorter pair of sides 52 of the dispenser 50 can be referred to as the width of the dispenser. In some embodiments, the container has a width of about one-fourth of the length of the first face mask.

In any of the embodiments of the stack of interfolded face masks disclosed herein, the number of face masks in the stack is unlimited and may be, for example, at least 10, 20, 30, 40, or 50 and up to, for example, 300, 250, 200, or 100. For stacks that have a larger number of face masks (e.g., more than 20), it can be useful to have a spring system in the base of the dispenser to urge the stack toward the opening as individual face masks are removed.

Figure 5A:
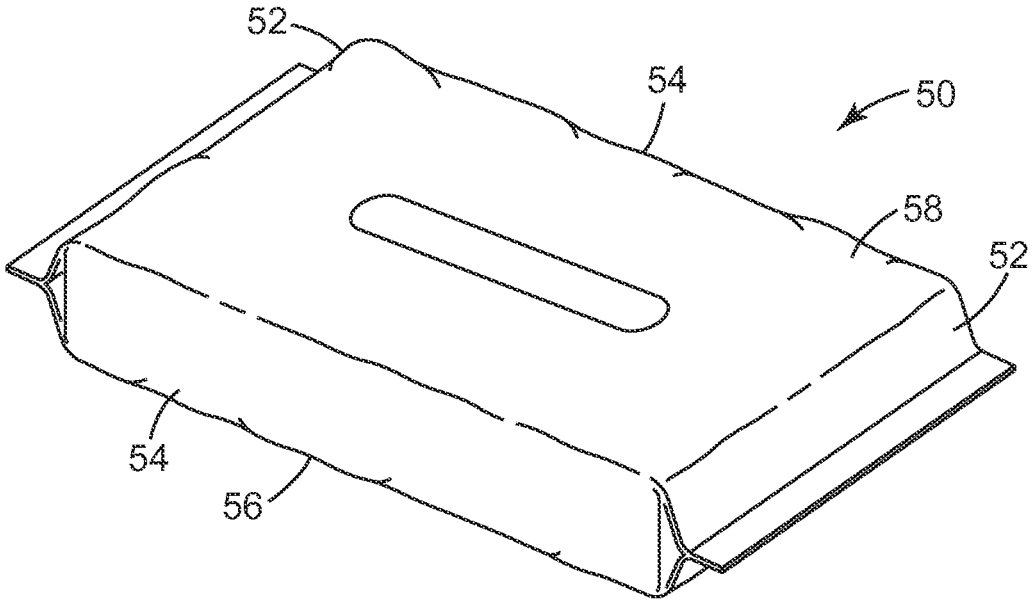
FIG. 5A is a perspective view of one embodiment of a dispenser for a plurality of face masks according to the present disclosure.
Figure 5B:
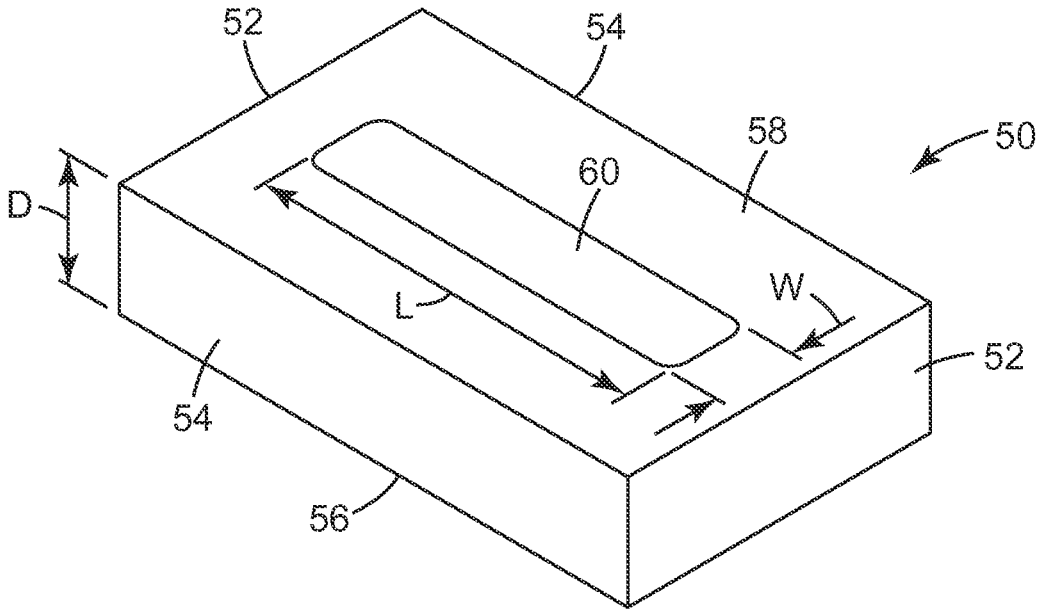
FIG. 5B is a perspective view of another embodiment of a dispenser for a plurality of face masks according to the present disclosure.
Figure 5C:
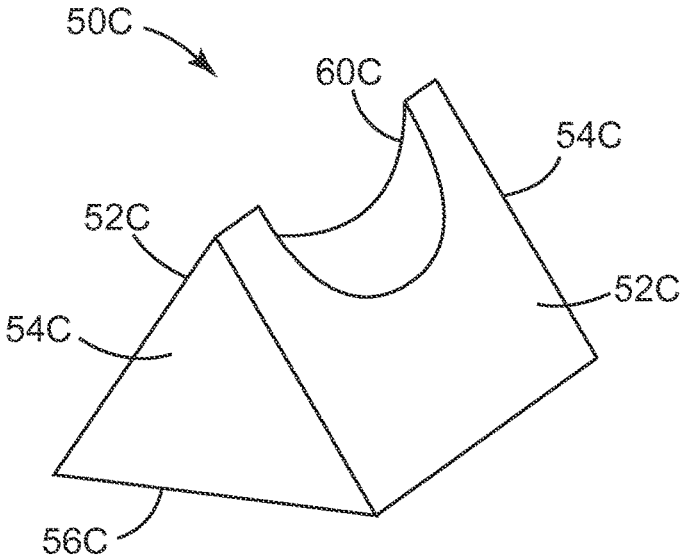
FIG. 5C is a perspective view of another embodiment of a dispenser for a plurality of face masks according to the present disclosure.

Exemplary dispensers for a plurality of the face masks according to and/or made according to the present disclosure are shown in FIGS. 5A, 5B, and 5C. A variety of different shapes and materials may be useful for dispensing the face masks. In some embodiments, the dispenser 50 is made of a flexible polymer film (e.g., polyethylene, polypropylene, or combinations thereof) or other flexible material as illustrated in FIG. 5A. In other embodiments, the dispenser 50 is made from a relatively more rigid material (e.g., paperboard or cardboard) as illustrated in FIG. 5B. The illustrated dispensers 50 has a pair of sides 52 that are contiguous with another pair of sides 54 and a bottom 56 in contact with the sides 52 and 54. The stack of interfolded face masks may rest on the bottom 56 of the dispensers 50 in FIGS. 5A and 5B. The sides 52 and 54 of the dispenser 50 have a depth D. In some embodiments, the depth D is up to half of the width of the face mask, wherein the width is the maximum dimension measured in the longitudinal direction L. In some embodiments, the ratio of the width of the face mask to the depth D is at least 2 (in some embodiments, at least 2.25, 2.5, 2.6, or 2.75) and may be up to about 3. Also in contact with sides 52 and 54 is a top 58 with an aperture 60 for removing the plurality of face masks. The aperture 60 may be revealed in some embodiments by removing a portion of the top 58 of the dispenser 50. The removable portion may be perforated. A variety of dispenser shapes may be useful for dispensing the plurality of face masks disclosed herein. For example, the dispenser may be in the shape of a cube; a triangular, square, or rectangular pyramid; a triangular, trapezoidal, or rectangular prism; cylinder; or another useful shape. An exemplary triangular prismatic-shaped dispenser 50*c* is shown in FIG. 5C. Dispenser 50*c* has two pairs of sides 52*c* and 54*c* and a base 56*c*. With a triangular prismatic shape as shown in FIG. 5C, for example, or a trapezoidal prism, a stack of face masks according to the present disclosure need not be interfolded for easy dispensing. For example, a stack of face masks in a flat configuration may be placed in a triangular or trapezoidal prismatic dispenser on top of a paper cylinder support in the base 56*c* of the prism. The paper cylinder urges the central portions of the face masks toward an aperture 60*c* in the top of the prism for easy removal.

Figure 6A:
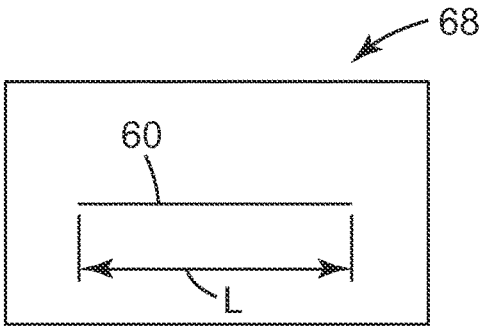
FIG. 6A is a top view of a dispenser showing one embodiment of an aperture through which the plurality of face masks disclosed herein can be dispensed.
Figure 6B:
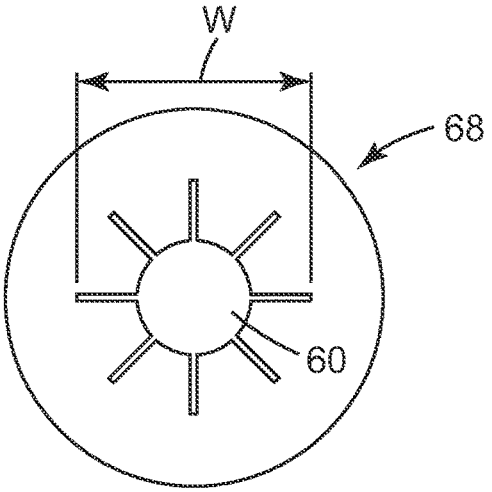
FIG. 6B is a top view of a dispenser showing another embodiment of an aperture through which the plurality of face masks disclosed herein can be dispensed.

Aperture 60 for removing the face masks from the container has an oval or generally rectangular shape in the embodiments illustrated in FIGS. 5A and 5B, respectively. Other shapes such as round, square, ovoid, or triangular are also possible. FIGS. 6A and 6B illustrate tops 68 of dispensers having other useful aperture shapes. In FIG. 6A, the aperture 60 is in the form of a slit, and a more structured aperture 60 is shown in FIG. 6B. Aperture 60 typically has a width W. In some embodiments, the aperture 60 may also have a length L. In apertures that are generally circular, as illustrated in FIG. 6B, or otherwise having multiple axes of symmetry, the width and the length may be the same. In some embodiments, the aperture has a width that is up to half of the width of the face mask, wherein the width is the maximum dimension measured in the longitudinal direction L. In some embodiments, the ratio of the width of the face mask to the width of the aperture is at least 2 (in some embodiments, at least 2.25, 2.5, 2.6, or 2.75) and may be up to about 3. When the ratio of the width of the face mask to the width of the aperture is less than 2, poor dispensing of an interfolded stack of face masks disclosed herein may result. For example, poor dispensing of an interfolded stack of face masks having a width of 4 inches (10.2 cm) was observed through the aperture shown in FIG. 6B with a width W of 2.375 inches (6.0 cm). In some embodiments, the at least one side of the container that has an aperture for removing face masks comprises a flexible polymer film. In some of these embodiments, the at least one side of the container comprises a rubbery material. The rubbery material may improve dispensing by holding up the top mask in a popped-up or partially dispensed position ready for easy removal. The dispenser may have more than one aperture, for example, to dispense the plurality of face masks disclosed herein from one aperture and tissues or wipes, for example, from another aperture.

Figure 7A:
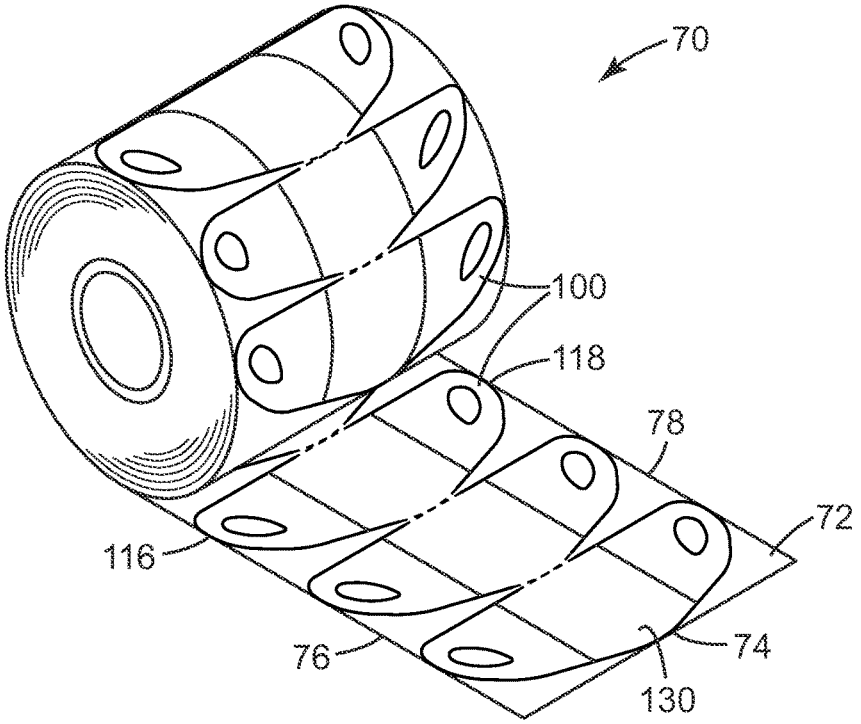
FIG. 7A is a perspective view of a roll formed from a continuous web of the face masks shown in FIG. 1.
Figure 7B:
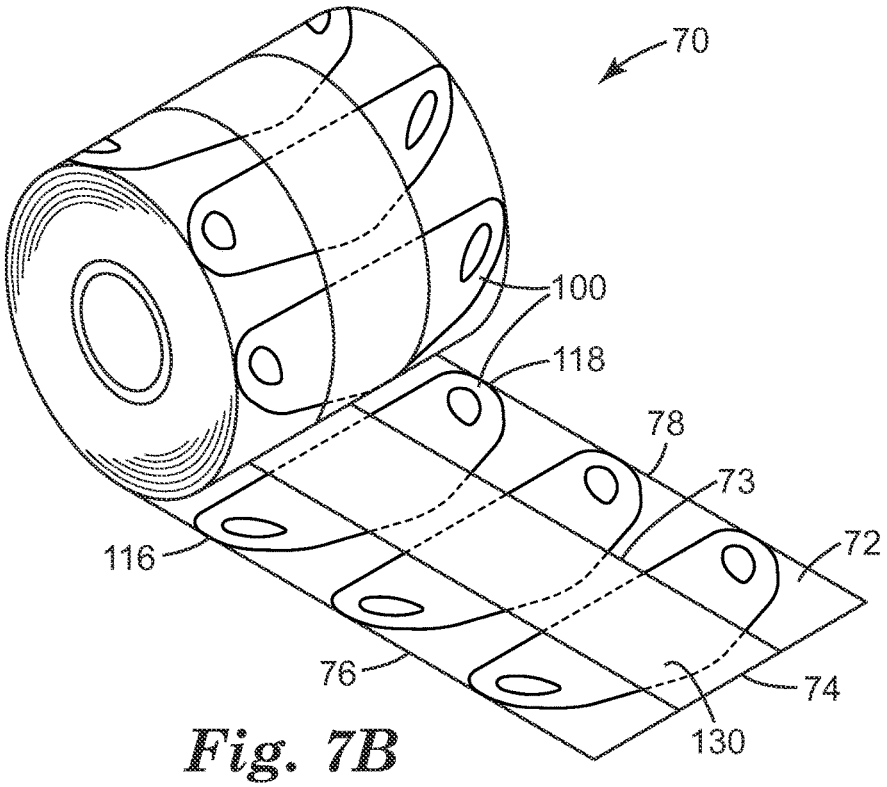
FIG. 7B is a perspective view of another embodiment of a roll formed from a continuous web of the face masks shown in FIG. 1.

A plurality of the face masks according to and/or made according to the present disclosure may also be dispensed from the continuous layered web described above. For example, the continuous layered web may be in the form of a roll of face masks 70 as shown in FIGS. 7A and 7B. In the illustrated embodiments, the roll is formed around a core. In some embodiments, the continuous layered web is formed into a roll without a core, and the face masks can be dispensed from the inside of the roll, for example, from a dispenser in the general form of a canister. In some embodiments, continuous layered web may be folded in alternating directions for dispensing.

For the continuous layered web according to the present disclosure, the plurality face masks may be stamped into the continuous web 72 but not removed from the continuous web 72 so that the web may be formed, for example, into a roll or otherwise dispensed from the continuous web. The solid lines represent solid cuts, and the remaining web portions not included in the plurality of face masks can be removed. The plurality of face masks 100 may be connected to one another through a perforated connection. The perforations may have a length and spacing as desired for the type of dispenser. For example, the face masks may be connected to each other at just two or three spaced apart points for dispensing from the center portion of a roll. The face masks 100 on the web may be in an abutting relationship as shown in FIG. 7A, or there may be space 73 between the face masks as shown in FIG. 7B. The space 73 may be useful, for example, so that the user need not touch the subsequent mask to be dispensed. Also, if the dispenser is provided with a hook strip near the aperture through which the face masks are dispensed, the hook strip may fasten to the space 73 to hold the next-to-be dispensed mask in place.

In the illustrated embodiments, the continuous web comprises a plurality of face masks 100 consecutively positioned in a machine direction, the continuous web having a first longitudinal edge 76 and a second longitudinal edge 78. A first lateral end portion 116 of the face mask extends to the first longitudinal edge 76 of the continuous layered web, and a second lateral end portion 118 extends to the second longitudinal edge 78 of the continuous layered web. In some embodiments, the first lateral end portion 116 and the second lateral end portion 118 can be folded onto the central portion before the plurality of face masks is rolled or folded for dispensing. The filtering web 130 (and optionally the second web) is bonded along a central lane 74 of the roll. In some embodiments, the filtering web 130 is bonded to the central lane 74 of the continuous web 72 in a manner such that at least a portion of the central lane has reduced elongation in at least one direction relative to the first and second lateral end portions 116 and 118. In some embodiments, the central lane 74 of the continuous web has up to 5 (in some embodiments, up to 4, 3, 2, or 1) percent elongation in the machine direction. Reduced elongation in the machine direction may be useful, for example, for convenient dispensing of the plurality of face masks from the roll. Separating the face masks from a continuous roll may be challenging for the user when the face mask is stretchable in the dispensing direction. The elongation of the central lane 74 of the continuous web can be controlled, for example, by the choice of materials, the extent of bonding of the filtering web, and the number of pleats in the filtering web as described above. In some embodiments, at the top and bottom edges of the face masks 100, in the central portion, the elongation may be up to 5 (in some embodiments, 4, 3, 2, or 1) percent in the transverse direction while between the top and bottom edges, the elongation may be greater than 5 and up to 15 (in some embodiments, up to 14, 13, 12, 11, or 10) percent in the transverse direction.

The rolls illustrated in FIGS. 7A and 7B may also be useful, for example, for transporting and storing the plurality of face masks disclosed herein, before they are enclosed in a dispenser.

Selected Embodiments of the Disclosure:

In a first embodiment, the present disclosure provides a method of making a face mask, the method comprising:

providing an elastic nonwoven web continuous in a machine direction, the elastic nonwoven web having a central lane extending in the machine direction, the central lane having a cross-web width;

bonding a filtering web to the central lane of the elastic nonwoven web to provide a layered web, the filtering web being continuous in the machine direction and having a cross-web width that is substantially the same as the cross-web width of the central lane; and stamping a face mask into the layered web, the face mask comprising a portion of the elastic nonwoven web and a portion of the filtering web, the portion of the elastic nonwoven web having an elongated shape with a central portion stamped from the central lane of the elastic nonwoven web and first and second lateral end portions each flanking the central portion on opposite sides, wherein the portion of the filtering web is bonded to the central portion.

In a second embodiment, the present disclosure provides a method according to the first embodiment, wherein the face mask further comprises a first opening in the first lateral end portion and a second opening in the second lateral end portion.

In a third embodiment, the present disclosure provides a method according to the first embodiment, wherein the face mask further comprises a first punch out member in the first lateral end portion and a second punch out member in the second lateral end portion.

In a fourth embodiment, the present disclosure provides a method according to any one of the first to third embodiments, further comprising pleating the filtering web so that the filtering web has at least one pleat extending in the machine direction.

In a fifth embodiment, the present disclosure provides a method according to the fourth embodiment, wherein pleating provides multiple pleats extending in the machine direction.

In a sixth embodiment, the present disclosure provides a method according to any one of the first to fifth embodiments, further comprising intermittently slitting the center lane of the elastic nonwoven web so that at least one cut is provided in the central portion of the face mask.

In a seventh embodiment, the present disclosure provides a method according to the sixth embodiment, wherein the cut has a length in a range from 10 percent to 100 percent of the longitudinal dimension of the face mask.

In an eighth embodiment, the present disclosure provides a method according to any one of the first to seventh embodiments, wherein the filtering web is bonded to the central lane of the elastic nonwoven web in a manner such that the central portion has a reduced elongation in at least one direction relative to the first and second lateral end portions.

In a ninth embodiment, the present disclosure provides a method according to any one of the first to eighth embodiments, further comprising:

bonding a second web continuous in the machine direction to the central portion of the elastic nonwoven web to provide the layered web.

In a tenth embodiment, the present disclosure provides a method according to the ninth embodiment, further comprising pleating the second web so that the second web has at least one pleat extending in the machine direction.

In an eleventh embodiment, the present disclosure provides a method according to the tenth embodiment, wherein pleating provides multiple pleats extending in the machine direction.

In a twelfth embodiment, the present disclosure provides a method according to any one of the ninth to eleventh embodiments, wherein the second web is elastic.

In a thirteenth embodiment, the present disclosure provides a method according to any one of the ninth to twelfth embodiments, wherein at least one of the filtering web or the second web comprises at least one of a nonwoven material or a microreplicated perforated film.

In a fourteenth embodiment, the present disclosure provides a method according to any one of the first to thirteenth embodiments, wherein at least a portion of the central portion of the elastic nonwoven web portion has an elongation of less than fifteen percent.

In a fifteenth embodiment, the present disclosure provides a method according to any one of the first to thirteenth embodiments, wherein at least a portion of the central portion of the elastic nonwoven web portion has an elongation of at least 70 percent.

In a sixteenth embodiment, the present disclosure provides a method according to any one of the first to fifteenth embodiments, wherein the central portion of the elastic nonwoven web portion has an elongation of up to five percent in the machine direction.

In a seventeenth embodiment, the present disclosure provides a method according to any one of the first to sixteenth embodiments, further comprising providing an adhesive strip with a removable liner on at least one of a top or a bottom edge of the face mask.

In an eighteenth embodiment, the present disclosure provides a face mask comprising:

an elastic nonwoven sheet having an elongated shape, a central portion, first and second lateral end portions each flanking the central portion on opposite sides, a first opening in the first lateral end portion, and a second opening in the second lateral end portion; and a filtering web portion bonded to the central portion of the elastic nonwoven sheet, wherein the filtering web portion is bonded to the central portion in a manner such that the central portion has a reduced elongation in at least one direction relative to the first and second lateral end portions.

In a nineteenth embodiment, the present disclosure provides a face mask according to the eighteenth embodiment, wherein the central portion at a top edge and a bottom edge of the face mask has a reduced elongation relative to the central portion between the top edge and the bottom edge.

In a twentieth embodiment, the present disclosure provides a face mask according to the eighteenth or nineteenth embodiment, wherein the filtering web portion has at least one pleat.

In a twenty-first embodiment, the present disclosure provides a face mask according to the twentieth embodiment, wherein the filtering web portion has multiple pleats.

In a twenty-second embodiment, the present disclosure provides a face mask according to any one of the eighteenth to twenty-first embodiments, wherein the elastic nonwoven sheet has at least one cut in the central portion.

In a twenty-third embodiment, the present disclosure provides a face mask according to the twenty-second embodiment, wherein the cut has a length in a range from 10 percent to 100 percent of the longitudinal dimension of the face mask.

In a twenty-fourth embodiment, the present disclosure provides a face mask according to any one of the eighteenth to twenty-third embodiments, further comprising a second web portion directly or indirectly bonded to the central portion of the elastic nonwoven sheet.

In a twenty-fifth embodiment, the present disclosure provides a face mask according to the twenty-fourth embodiment, wherein the second web portion comprises at least one of a microreplicated perforated web or a nonwoven material that is optionally elastic, and wherein the filtering web portion comprises at least one of a microreplicated perforated web or a nonwoven material.

In a twenty-sixth embodiment, the present disclosure provides a face mask according to any one of the eighteenth to twenty-fifth embodiments, wherein at least a portion of the central portion of the elastic nonwoven sheet has an elongation of less than fifteen percent.

In a twenty-seventh embodiment, the present disclosure provides a face mask according to any one of the eighteenth to twenty-fifth embodiments, wherein at least a portion of the central portion of the elastic nonwoven sheet has an elongation of at least 70 percent.

In a twenty-eighth embodiment, the present disclosure provides a face mask according to any one of the eighteenth to twenty-seventh embodiments, further comprising an adhesive tape or an adhesive strip disposed on at least one of a top or a bottom edge of the face mask, wherein the adhesive tape or the adhesive strip is provided with a removable liner.

In a twenty-ninth embodiment, the present disclosure provides a continuous layered web comprising a plurality of face masks consecutively positioned in a machine direction, the continuous layered web having a first longitudinal edge and a second longitudinal edge, each of the face masks comprising a portion of an elastic nonwoven web and a portion of a filtering web, the portion of the elastic nonwoven web having an elongated shape, a central portion, and first and second lateral end portions each flanking the central portion on opposite sides, the first lateral end portion extending to the first longitudinal edge of the continuous layered web and the second lateral end portion extending to the second longitudinal edge of the continuous web, wherein the portion of the filtering web is bonded to the central portion.

In a thirtieth embodiment, the present disclosure provides a dispenser comprising a container enclosing a plurality of face masks comprising a face mask according to any one of the eighteenth to twenty-eighth embodiments, the container having at least one side with an aperture for removing the plurality of face masks.

In a thirty-first embodiment, the present disclosure provides a dispenser according to the thirtieth embodiment, wherein the container has a width of up to one-third of the length of the first face mask.

In a thirty-second embodiment, the present disclosure provides a flat, stretchable face mask comprising a layer of elastic material and at least one partial layer of a flat-pleated material having at least one flat pleat, wherein upon stretching the flat, stretchable face mask, the elastic material stretches and the at least one flat pleat at least partially opens to expand the at least one partial layer.

In a thirty-third embodiment, the present disclosure provides a flat, stretchable face mask according to the thirty-second embodiment, where there is at least one cut in the layer of elastic material.

In a thirty-fourth embodiment, the present disclosure provides a flat, stretchable face mask according to the thirty-second or thirty-third embodiment, wherein the flat pleated material has multiple flat pleats.

This disclosure may take on various modifications and alterations without departing from its spirit and scope. Accordingly, this disclosure is not limited to the above-described embodiments but is to be controlled by the limitations set forth in the following claims and any equivalents thereof. This disclosure may be suitably practiced in the absence of any element not specifically disclosed herein. All patents and patent applications cited above are hereby incorporated by reference into this document in their entirety.

What is claimed is:

1. A face mask comprising:

an elastic nonwoven sheet having an elongated shape, a central portion, first and second lateral end portions each flanking the central portion on opposite sides, a first opening in the first lateral end portion, and a second opening in the second lateral end portion; and a filtering web portion bonded to the central portion of the elastic nonwoven sheet, wherein the filtering web portion is bonded to the central portion in a manner such that the central portion has a reduced elongation in at least one direction relative to the first and second lateral end portions, wherein the filtering web portion has at least two pleats, and wherein the elastic nonwoven sheet has at least two cuts in the central portion and wherein a number of cuts is the same as a number of pleats.

2. A method of making the face mask of claim 1, the method comprising:

providing an elastic nonwoven web continuous in a machine direction, the elastic nonwoven web having a central lane extending in the machine direction, the central lane having a cross-web width;

bonding a filtering web to the central lane of the elastic nonwoven web to provide a layered web, the filtering web being continuous in the machine direction and having a cross-web width that is substantially the same as the cross-web width of the central lane, wherein the filtering web has at least two pleats extending in the machine direction;

stamping a face mask into the layered web, the face mask comprising a portion of the elastic nonwoven web and a portion of the filtering web, the portion of the elastic nonwoven web having an elongated shape with a central portion stamped from the central lane of the elastic nonwoven web and first and second lateral end portions each flanking the central portion on opposite sides, wherein the portion of the filtering web is bonded to the central portion, wherein the face mask further comprises a first opening in the first lateral end portion and a second opening in the second lateral end portion; and intermittently slitting the center lane of the elastic nonwoven web so that at least two cuts is provided in the central portion of the face mask.

3. The method according to claim 2, further comprising:

bonding a second web continuous in the machine direction to the central portion of the elastic nonwoven web to provide the layered web.

4. The method according to claim 3, further comprising pleating at least one of the filtering web or the second web such that it has at least two pleats extending in the machine direction.

5. The face mask according to claim 1, wherein the central portion at a top edge and a bottom edge of the face mask has a reduced elongation relative to the central portion between the top edge and the bottom edge.

6. The face mask according to claim 1, wherein the at least two cuts in the central portion has a length that is at least 30 percent of a longitudinal dimension of the face mask.

7. The face mask according to claim 1, further comprising a second web portion directly or indirectly bonded to the central portion of the elastic nonwoven sheet.

8. The face mask according to claim 7, wherein the second web portion has at least two pleats.

9. The face mask according to claim 1, wherein at least a portion of the central portion of the elastic nonwoven sheet has an elongation of less than fifteen percent, or wherein at least a portion of the central portion of the elastic nonwoven sheet has an elongation of at least 70 percent.

10. A dispenser comprising a container enclosing a plurality of face masks comprising a face mask according to claim 1, the container having at least one side with an aperture for removing the plurality of face masks.

11. The dispenser according to claim 10, wherein the dispenser is in the shape of a prism, and wherein the plurality of face masks are placed on top of a support in the base of the prism.

12. A continuous layered web comprising a plurality of face masks according to claim 1 consecutively positioned in a machine direction, the continuous layered web having a first longitudinal edge and a second longitudinal edge, each of the face masks comprising a portion of an elastic nonwoven web and a portion of a filtering web, the portion of the elastic nonwoven web having an elongated shape, a central portion, and first and second lateral end portions each flanking the central portion on opposite sides, the first lateral end portion extending to the first longitudinal edge of the continuous layered web and the second lateral end portion extending to the second longitudinal edge of the continuous web, wherein the portion of the filtering web is bonded to the central portion.

13. The continuous layered web of claim 12, wherein there are spaces between the face masks in the plurality of face masks.

14. The face mask according to claim 1, further comprising an adhesive tape or an adhesive strip disposed on at least one of a top or a bottom edge of the face mask, wherein the adhesive tape or the adhesive strip is provided with a removable liner.

15. The face mask according to claim 1, wherein the at least two flat pleats are configured to expand into an opening formed from the at least two cuts in the central portion of the elastic nonwoven sheet.

16. The face mask according to claim 1, further comprising a pad removable through the at least one cut.

17. The face mask according to claim 1, wherein the at least two cuts in the central portion extend in the direction of the at least two pleats and are positioned over the at least two pleats.

18. A flat, stretchable face mask comprising a layer of elastic material and at least one partial layer of a flat-pleated material having at least two flat pleats, wherein the elastic layer comprises first and second lateral end portions each configured to at least partially extend around opposite sides of a person's face to engage an ear of the person, wherein there is at least two cuts in the layer of elastic material extending in the direction of the at least two flat pleats, wherein upon stretching the flat, stretchable face mask around opposites sides of the person's face, the elastic material stretches and the at least two flat pleats at least partially opens to expand the at least one partial layer, and wherein the at least two flat pleats are configured to expand into an opening formed from the at least two cuts in the layer of elastic material; and wherein a number of cuts is the same as a number of pleats.

* * * * *